US011602175B2

(12) United States Patent
Griffith, Jr. et al.

(10) Patent No.: US 11,602,175 B2
(45) Date of Patent: Mar. 14, 2023

(54) SMOKING ARTICLE INCORPORATING A CONDUCTIVE SUBSTRATE

(71) Applicant: RAI Strategic Holdings, Inc., Winston-Salem, NC (US)

(72) Inventors: David William Griffith, Jr., Winston-Salem, NC (US); Yi-Ping Chang, Greensboro, NC (US); Calvin W. Henderson, Lewisville, NC (US); Ricky Lee Montgomery, Germanton, NC (US); Walter Charles Liebscher, II, Trinity, NC (US); Chandra Kumar Banerjee, San Jose, CA (US); Paul E. Braxton, Summerfield, NC (US); Stephen Benson Sears, Siler City, NC (US); Kenneth Allen Beard, Lexington, NC (US); Timothy Brian Nestor, Advance, NC (US); Balager Ademe, Winston-Salem, NC (US); Frederic Philippe Ampolini, Winston-Salem, NC (US); Dennis Lee Potter, Kernersville, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 311 days.

(21) Appl. No.: 16/866,245

(22) Filed: May 4, 2020

(65) Prior Publication Data

US 2020/0260784 A1 Aug. 20, 2020

Related U.S. Application Data

(62) Division of application No. 13/432,406, filed on Mar. 28, 2012, now abandoned.

(51) Int. Cl.
*A24F 40/46* (2020.01)
*A24F 40/30* (2020.01)
(Continued)

(52) U.S. Cl.
CPC ..... *A24F 40/46* (2020.01); *A24F 15/01* (2020.01); *A24F 40/30* (2020.01); *A24F 40/50* (2020.01); *A24F 40/70* (2020.01); *A24F 40/20* (2020.01)

(58) Field of Classification Search
None
See application file for complete search history.

(56) References Cited

U.S. PATENT DOCUMENTS 1,771,366 A 7/1930 Wyss et al.
2,057,353 A 10/1936 Whittemore, Jr.
(Continued)

FOREIGN PATENT DOCUMENTS

AU 276250 7/1965
CA 2 641 869 5/2010
(Continued)

*Primary Examiner* — Phu H Nguyen
(74) *Attorney, Agent, or Firm* — Womble Bond Dickinson (US) LLP

(57) ABSTRACT

The present invention provides a conductive substrate useful for Joule heating, such as in an electronic smoking article. Particularly, the invention provides a resistive heating element formed of a conductive substrate. The conductive substrate comprises an electrically conductive material and a carbonaceous additive, such as a binder material. The conductive substrate is carbonized in that it is subjected to calcining conditions to effectively reduce the carbonaceous additive to its carbon skeleton. It has been found that such carbonized substrate has surprisingly improved resistance properties in relation a substrate of the same formulation that is not carbonized. The carbonized substrate can include an aerosol precursor material. The formed resistive heating element can be included in an electronic smoking article to simultaneously provide resistive heating and aerosol formation with a single, unitary component.

25 Claims, 12 Drawing Sheets

(51) Int. Cl.

| | |
|---|---|
| ***A24F 15/01*** | (2020.01) |
| ***A24F 40/50*** | (2020.01) |
| ***A24F 40/70*** | (2020.01) |
| ***A24F 40/20*** | (2020.01) |

(56) References Cited

U.S. PATENT DOCUMENTS

| | | | |
|---|---|---|---|
| 2,104,266 | A | 1/1938 | McCormick |
| 2,805,669 | A | 9/1957 | Meriro |
| 3,111,396 | A | 11/1963 | Ball |
| 3,200,819 | A | 8/1965 | Gilbert |
| 3,316,919 | A | 5/1967 | Green et al. |
| 3,398,754 | A | 8/1968 | Tughan |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |
| 4,150,677 | A | 4/1979 | Osborne |
| 4,190,046 | A | 2/1980 | Virag |
| 4,219,032 | A | 8/1980 | Tabatznik et al. |
| 4,259,970 | A | 4/1981 | Green, Jr. |
| 4,284,089 | A | 8/1981 | Ray |
| 4,303,083 | A | 12/1981 | Burruss, Jr. |
| 4,449,541 | A | 5/1984 | Mays et al. |
| 4,506,682 | A | 3/1985 | Muller |
| 4,635,651 | A | 1/1987 | Jacobs |
| 4,674,519 | A | 6/1987 | Keritsis et al. |
| 4,708,151 | A | 11/1987 | Shelar |
| 4,714,082 | A | 12/1987 | Banerjee et al. |
| 4,735,217 | A | 4/1988 | Gerth et al. |
| 4,756,318 | A | 7/1988 | Clearman et al. |
| 4,771,795 | A | 9/1988 | White et al. |
| 4,776,353 | A | 10/1988 | Lilja et al. |
| 4,793,365 | A | 12/1988 | Sensabaugh, Jr. et al. |
| 4,800,903 | A | 1/1989 | Ray et al. |
| 4,819,665 | A | 4/1989 | Roberts et al. |
| 4,821,749 | A | 4/1989 | Toft et al. |
| 4,830,028 | A | 5/1989 | Lawson et al. |
| 4,836,224 | A | 6/1989 | Lawson et al. |
| 4,836,225 | A | 6/1989 | Sudoh |
| 4,848,374 | A | 7/1989 | Chard et al. |
| 4,848,376 | A | 7/1989 | Lilja et al. |
| 4,874,000 | A | 10/1989 | Tamol et al. |
| 4,880,018 | A | 11/1989 | Graves, Jr. et al. |
| 4,887,619 | A | 12/1989 | Burcham, Jr. et al. |
| 4,907,606 | A | 3/1990 | Lilja et al. |
| 4,913,168 | A | 4/1990 | Potter et al. |
| 4,916,292 | A | 4/1990 | Kawakubo et al. |
| 4,917,119 | A | 4/1990 | Potter et al. |
| 4,917,128 | A | 4/1990 | Clearman et al. |
| 4,922,901 | A | 5/1990 | Brooks et al. |
| 4,924,888 | A | 5/1990 | Perfetti et al. |
| 4,928,714 | A | 5/1990 | Shannon |
| 4,938,236 | A | 7/1990 | Banerjee et al. |
| 4,941,483 | A | 7/1990 | Ridings et al. |
| 4,941,484 | A | 7/1990 | Clapp et al. |
| 4,945,931 | A | 8/1990 | Gori |
| 4,947,874 | A | 8/1990 | Brooks et al. |
| 4,947,875 | A | 8/1990 | Brooks et al. |
| 4,972,854 | A | 11/1990 | Kiernan et al. |
| 4,972,855 | A | 11/1990 | Kuriyama et al. |
| 4,986,286 | A | 1/1991 | Roberts et al. |
| 4,987,906 | A | 1/1991 | Young et al. |
| 5,005,593 | A | 4/1991 | Fagg |
| 5,019,122 | A | 5/1991 | Clearman et al. |
| 5,022,416 | A | 6/1991 | Watson |
| 5,042,510 | A | 8/1991 | Curtiss et al. |
| 5,056,537 | A | 10/1991 | Brown et al. |
| 5,060,669 | A | 10/1991 | White et al. |
| 5,060,671 | A | 10/1991 | Counts et al. |
| 5,065,775 | A | 11/1991 | Fagg |
| 5,072,744 | A | 12/1991 | Luke et al. |
| 5,074,319 | A | 12/1991 | White et al. |
| 5,076,296 | A | 12/1991 | Nystrom et al. |
| 5,093,894 | A | 3/1992 | Deevi et al. |
| 5,095,921 | A | 3/1992 | Losee et al. |
| 5,097,850 | A | 3/1992 | Braunshteyn et al. |
| 5,099,862 | A | 3/1992 | White et al. |
| 5,099,864 | A | 3/1992 | Young et al. |
| 5,103,842 | A | 4/1992 | Strang et al. |
| 5,121,757 | A | 6/1992 | White et al. |
| 5,129,409 | A | 7/1992 | White et al. |
| 5,131,415 | A | 7/1992 | Munoz et al. |
| 5,143,097 | A | 9/1992 | Sohn et al. |
| 5,144,962 | A | 9/1992 | Counts et al. |
| 5,146,934 | A | 9/1992 | Deevi et al. |
| 5,159,940 | A | 11/1992 | Hayward et al. |
| 5,159,942 | A | 11/1992 | Brinkley et al. |
| 5,179,966 | A | 1/1993 | Losee et al. |
| 5,211,684 | A | 5/1993 | Shannon et al. |
| 5,220,930 | A | 6/1993 | Gentry |
| 5,224,498 | A | 7/1993 | Deevi et al. |
| 5,228,460 | A | 7/1993 | Sprinkel, Jr. et al. |
| 5,230,354 | A | 7/1993 | Smith et al. |
| 5,235,992 | A | 8/1993 | Sensabaugh |
| 5,243,999 | A | 9/1993 | Smith |
| 5,246,018 | A | 9/1993 | Deevi et al. |
| 5,249,586 | A | 10/1993 | Morgan et al. |
| 5,261,424 | A | 11/1993 | Sprinkel, Jr. |
| 5,269,327 | A | 12/1993 | Counts et al. |
| 5,285,798 | A | 2/1994 | Banerjee et al. |
| 5,293,883 | A | 3/1994 | Edwards |
| 5,301,694 | A | 4/1994 | Raymond |
| 5,303,720 | A | 4/1994 | Banerjee et al. |
| 5,318,050 | A | 6/1994 | Gonzalez-Parra et al. |
| 5,322,075 | A | 6/1994 | Deevi et al. |
| 5,322,076 | A | 6/1994 | Brinkley et al. |
| 5,339,838 | A | 8/1994 | Young et al. |
| 5,345,951 | A | 9/1994 | Serrano et al. |
| 5,353,813 | A | 10/1994 | Deevi et al. |
| 5,357,984 | A | 10/1994 | Farrier et al. |
| 5,360,023 | A | 11/1994 | Blakley et al. |
| 5,369,723 | A | 11/1994 | Counts et al. |
| 5,372,148 | A | 12/1994 | McCafferty et al. |
| 5,377,698 | A | 1/1995 | Litzinger et al. |
| 5,388,574 | A | 2/1995 | Ingebrethsen et al. |
| 5,388,594 | A | 2/1995 | Counts et al. |
| 5,408,574 | A | 4/1995 | Deevi et al. |
| 5,435,325 | A | 7/1995 | Clapp et al. |
| 5,445,169 | A | 8/1995 | Brinkley et al. |
| 5,468,266 | A | 11/1995 | Bensalem et al. |
| 5,468,936 | A | 11/1995 | Deevi et al. |
| 5,479,948 | A | 1/1996 | Counts et al. |
| 5,498,850 | A | 3/1996 | Das |
| 5,498,855 | A | 3/1996 | Deevi et al. |
| 5,499,636 | A | 3/1996 | Baggett, Jr. et al. |
| 5,501,237 | A | 3/1996 | Young et al. |
| 5,505,214 | A | 4/1996 | Collins et al. |
| 5,530,225 | A | 6/1996 | Hajaligol |
| 5,551,450 | A | 9/1996 | Hemsley |
| 5,551,451 | A | 9/1996 | Riggs et al. |
| 5,564,442 | A | 10/1996 | MacDonald et al. |
| 5,573,692 | A | 11/1996 | Das et al. |
| 5,591,368 | A | 1/1997 | Fleischhauer et al. |
| 5,593,792 | A | 1/1997 | Farrier et al. |
| 5,595,577 | A | 1/1997 | Bensalem et al. |
| 5,596,706 | A | 1/1997 | Sikk et al. |
| 5,611,360 | A | 3/1997 | Tang |
| 5,613,504 | A | 3/1997 | Collins et al. |
| 5,613,505 | A | 3/1997 | Campbell et al. |
| 5,649,552 | A | 7/1997 | Cho et al. |
| 5,649,554 | A | 7/1997 | Sprinkel et al. |
| 5,659,656 | A | 8/1997 | Das |
| 5,665,262 | A | 9/1997 | Hajaligol et al. |
| 5,666,976 | A | 9/1997 | Adams et al. |
| 5,666,977 | A | 9/1997 | Higgins |
| 5,666,978 | A | 9/1997 | Counts et al. |
| 5,692,525 | A | 12/1997 | Counts et al. |
| 5,692,526 | A | 12/1997 | Adams et al. |
| 5,708,258 | A | 1/1998 | Counts et al. |
| 5,711,320 | A | 1/1998 | Martin |
| 5,726,421 | A | 3/1998 | Fleischhauer et al. |
| 5,727,571 | A | 3/1998 | Meiring et al. |

(56) References Cited

U.S. PATENT DOCUMENTS 5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,164,287 A 2/2000 White
6,033,506 A 3/2000 Klett
6,033,623 A 3/2000 Deevi et al.
6,037,032 A 3/2000 Klett et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,182,670 B1 2/2001 White
6,196,218 B1 3/2001 Voges
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,729,269 B2 5/2004 Ott et al.
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,810,505 B2 10/2010 Yang
7,832,410 B2 11/2010 Hon
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,372,510 B2 2/2013 Miller et al.
9,307,787 B2 4/2016 Sun et al.
2002/0146242 A1 10/2002 Vieira
2002/0164169 A1 11/2002 Arai et al.
2003/0131859 A1 7/2003 Li et al.
2003/0226837 A1 12/2003 Blake et al.
2004/0017203 A1 1/2004 Becker et al.
2004/0020500 A1 2/2004 Wrenn et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0157578 A1 7/2005 Noguchi et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0011673 A1 1/2009 Ko et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0209823 A1 8/2010 Ko et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.

(56) References Cited

U.S. PATENT DOCUMENTS

| | | | |
|---|---|---|---|
| 2011/0155718 | A1 | 6/2011 | Greim et al. |
| 2011/0162663 | A1 | 7/2011 | Bryman |
| 2011/0168194 | A1 | 7/2011 | Hon |
| 2011/0180082 | A1 | 7/2011 | Banerjee et al. |
| 2011/0226236 | A1 | 9/2011 | Buchberger |
| 2011/0265806 | A1 | 11/2011 | Alarcon et al. |
| 2011/0309157 | A1 | 12/2011 | Yang et al. |
| 2012/0042885 | A1 | 2/2012 | Stone et al. |
| 2012/0060853 | A1 | 3/2012 | Robinson et al. |
| 2012/0111347 | A1 | 5/2012 | Hon |
| 2012/0132643 | A1 | 5/2012 | Choi et al. |
| 2012/0231464 | A1 | 9/2012 | Yu et al. |
| 2012/0279512 | A1 | 11/2012 | Hon |
| 2012/0318882 | A1 | 12/2012 | Abehasera |
| 2013/0081642 | A1 | 4/2013 | Safari |
| 2013/0220315 | A1 | 8/2013 | Conley et al. |
| 2013/0306084 | A1 | 11/2013 | Flick |
| 2013/0319440 | A1 | 12/2013 | Capuano |
| 2013/0340775 | A1 | 12/2013 | Juster et al. |
| 2014/0238422 | A1 | 8/2014 | Plunkett et al. |

FOREIGN PATENT DOCUMENTS

| | | |
|---|---|---|
| CA | 2 752 255 | 8/2010 |
| CN | 1040914 | 4/1990 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 101407323 | 4/2009 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| EP | 2 468 116 | 6/2012 |
| GB | 1444461 | 7/1976 |
| GB | 2469850 | 11/2010 |
| WO | WO 1986/02528 | 5/1986 |
| WO | WO 1997/48293 | 12/1997 |
| WO | WO 02/37990 | 5/2002 |
| WO | WO 2004/043175 | 5/2004 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2010/073122 | 7/2011 |
| WO | WO 2011/081558 | 7/2011 |

SMOKING ARTICLE INCORPORATING A CONDUCTIVE SUBSTRATE

FIELD OF THE INVENTION

The present invention relates to aerosol delivery articles and uses thereof for yielding tobacco components or other materials in an inhalable form. The articles may be made or derived from tobacco or otherwise incorporate tobacco for human consumption.

BACKGROUND OF THE INVENTION

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Numerous references have proposed various smoking articles of a type that generate flavored vapor, visible aerosol, or a mixture of flavored vapor and visible aerosol. Some of those proposed types of smoking articles include tubular sections or longitudinally extending air passageways.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco.

General examples of alternative smoking articles are described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez; which are incorporated herein by reference in their entireties. Furthermore, certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). See also US Pat. Pub. No. 2005/0274390 to Banerjee et al., US Pat. Pub. No. 2007/0215167 to Crooks et al., US Pat. Pub. No. 2010/0065075 to Banerjee et al., and US Pat. Pub. No. 2012/0042885 to Stone et al., the disclosures of which are incorporated herein by reference in their entireties.

Certain proposed cigarette-shaped tobacco products purportedly employ tobacco in a form that is not intended to be burned to any significant degree. See, for example, U.S. Pat. No. 4,836,225 to Sudoh; U.S. Pat. No. 4,972,855 to Kuriyama et al.; and U.S. Pat. No. 5,293,883 to Edwards, which are incorporated herein by reference in their entireties. Yet other types of smoking articles, such as those types of smoking articles that generate flavored vapors by subjecting tobacco or processed tobaccos to heat produced from chemical or electrical heat sources, are described in U.S. Pat. No. 4,848,374 to Chard et al.; U.S. Pat. Nos. 4,947,874 and 4,947,875 to Brooks et al.; U.S. Pat. No. 5,060,671 to Counts et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,692,525 to Counts et al.; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; U.S. Pat. No. 6,033,623 to Deevi et al.; U.S. Pat. No. 6,053,176 to Adams et al.; U.S. Pat. No. 6,164,287 to White; U.S. Pat. No. 6,289,898 to Fournier et al.; U.S. Pat. No. 6,615,840 to Fournier et al.; U.S. Pat. Pub. No. 2003/0131859 to Li et al.; U.S. Pat. Pub. No. 2005/0016549 to Banerjee et al.; and U.S. Pat. Pub. No. 2006/0185687 to Hearn et al., each of which is incorporated herein by reference in its entirety.

Certain attempts have been made to deliver vapors, sprays or aerosols, such as those possessing or incorporating flavors and/or nicotine. See, for example, the types of devices set forth in U.S. Pat. No. 4,190,046 to Virag; U.S. Pat. No. 4,284,089 to Ray; U.S. Pat. No. 4,635,651 to Jacobs; U.S. Pat. No. 4,735,217 to Gerth et al.; U.S. Pat. No. 4,800,903 to Ray et al.; U.S. Pat. No. 5,388,574 to Ingebrethsen et al.; U.S. Pat. No. 5,799,663 to Gross et al.; U.S. Pat. No. 6,532,965 to Abhulimen et al.; and U.S. Pat. No. 6,598,607 to Adiga et al; and EP 1,618,803 to Hon; which are incorporated herein by reference in their entireties. See also, U.S. Pat. No. 7,117,867 to Cox et al. and the devices set forth on the website, www.e-cig.com, which are incorporated herein by reference in their entireties.

Still further representative cigarettes or smoking articles that have been described and, in some instances, been made commercially available include those described in U.S. Pat. No. 4,922,901 to Brooks et al.; U.S. Pat. No. 5,249,586 to Morgan et al.; U.S. Pat. No. 5,388,594 to Counts et al.; U.S.

Pat. No. 5,666,977 to Higgins et al.; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; US Pat. Pub. No. 2009/0095311 to Hon; US Pat. Pub. Nos. 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. Still further examples include electronic cigarette products commercially available under the names ACCORD®; HEATBAR™; HYBRID CIGARETTE®, VEGAS™; E-GAR™; C-GAR™; E-MYSTICK™; IOLITE Vaporizer, GREEN SMOKE®, BLU™ Cigs, WHITE CLOUD® Cirrus, V2CIGS™ SOUTH BEACH SMOKE™, SMOKETIP®, SMOKE STIK®, NJOY®, LUCI®, Royal Blues, SMART SMOKER®, SMOKE ASSIST®, Knight Sticks, GAMUCCI®, InnoVapor, SMOKING EVERYWHERE®, Crown 7, CHOICE™ NO. 7™, VAPORKING®, EPUFFER®, LOGIC™ ecig, VAPOR4LIFE®, NICOTEK®, METRO °, and PREMIUM™.

Smoking articles that employ tobacco substitute materials and smoking articles that employ sources of heat other than burning tobacco cut filler to produce tobacco-flavored vapors or tobacco-flavored visible aerosols have not received widespread commercial success. Articles that produce the taste and sensation of smoking by electrically heating tobacco particularly have suffered from inconsistent release of flavors or other inhalable materials. Electrically heated smoking devices have further been limited in many instances to the requirement of an external heating device that was inconvenient and that detracted from the smoking experience. Accordingly, it can be desirable to provide a smoking article that can provide the sensations of cigarette, cigar, or pipe smoking, that does so without combusting tobacco, that does so without the need of a combustion heat source, and that does so without necessarily delivering considerable quantities of incomplete combustion and pyrolysis products.

BRIEF SUMMARY OF THE INVENTION

The present invention provides articles that are useful for oral delivery of inhalable materials. The articles particularly comprise a resistive heating element formed of a conductive substrate wherein an electrically conductive material is integrally formed with a carrier material that can be coated or impregnated with materials that can be vaporized or aerosolized for inhalation. The formed aerosol and/or vapor can be inhaled similarly to the manner of smoking a conventional cigarette. Thus, the inventive article can particularly be referred to as a smoking article.

In one aspect, the invention thus provides a resistive heating element. The resistive heating element beneficially includes components sufficient such that the resistive heating element functions as both a heating element and a substrate for retaining an aerosol precursor and other optional materials. For example, the resistive heating element can comprise a substrate that is formed from an electrically conductive material and at least one carbonaceous additive. Preferably, the substrate, or at least a part thereof, is carbonized (i.e., has been subjected to calcining conditions, preferably in an inert atmosphere, so as to increase the relative carbon content of the substrate). For example, in some embodiments, the conductive substrate may comprise a plurality of components that are combined (e.g., a core wrapped by a further material or an exterior material wrapping a core, wherein only one of the core and the exterior wrapping material is carbonized). The resistive heating element further can comprise an aerosol precursor material associated with the carbonized substrate. Beneficially, such resistive heating element can exhibit an electrical resistance making the material useful for providing resistive heating in response to an applied current. For example, the resistive heating element can exhibit an electrical resistance of about 25 ohms or less in some embodiments. More preferably, the resistive heating element can have an electrical resistance of about 10 ohms or less, or the electrical resistance can be in the range of about 0.1 ohms to about 10 ohms. Because the resistive heating element is formed of a combination of a substrate and an electrically conductive material, a conductive substrate as discussed herein can be considered to be a resistive heating element.

A variety of electrically conductive materials can be used in the resistive heating element. For example, the electrically conductive material can comprise graphite. In other embodiments, the electrically conductive material can comprise a metal. The electrically conductive material specifically can be used in a particulate form.

The carbonaceous additive of the substrate can encompass a variety of materials. For example, the carbonaceous additive can comprise tobacco or a tobacco derivative. In some embodiments, the carbonaceous additive can simply comprise elemental carbon, such as a milled carbon or an activated carbon. In embodiments where elemental carbon is used, it can be beneficial to include one or more further carbonaceous additives. For example, the carbonaceous additive can comprise a binder, which can be a polysaccharide or a derivative thereof. More particularly, a useful binder can comprise a gum, a cellulose material, or a cellulose derivative. Non-limiting examples include guar gum, carboxymethyl cellulose, and combinations thereof. Inorganic binders also can be used.

The resistive heating element particularly can be characterized in relation to its carbonized condition. For example, the carbonized substrate can have a specific porosity, such as a porosity of about 10% or greater. The carbonized substrate likewise can be characterized in relation to the relative carbon content of the substrate, as already noted above. In specific embodiments, the weight percent of carbon in the carbonized substrate relative to the total weight of the carbonized substrate can exceed the weight percent of carbon in the non-carbonized substrate relative to the total weight of the non-carbonized substrate. For example, the weight percent of carbon in the carbonized substrate can exceed the weight percent of carbon in the non-carbonized substrate by about 10% or greater.

The aerosol precursor material used in the resistive heating element can comprise any material that is volatilizable at the working temperatures discussed herein so as to form an aerosol, vapor, or the like suitable for inhalation by a consumer. The aerosol precursor material further can comprise materials that are suitable for being entrained in an aerosol or vapor for inhalation along with the aerosol or vapor. In specific embodiments, a useful aerosol precursor material can be a polyhydric alcohol, such as glycerin, propylene glycol, and combinations thereof. The aerosol precursor material particularly can be combined with an inhalable substance. In other words, a separate material can be provided with the aerosol precursor material on the substrate (either as a mixture or as separate applications on the substrate). As such, the aerosol formed upon heating can include a content of the inhalable substance as a result of likewise being aerosolized or as being substantially carried by the otherwise formed aerosol. In certain embodiments, the inhalable substance can comprise a medicament and, more specifically, can comprise nicotine. In some embodiments, the inhalable substance can comprise a tobacco component or a tobacco-derived material. For example, the aerosol precursor material can be in a slurry with tobacco, a tobacco component, or a tobacco-derived material. Still further, the aerosol precursor material can be combined with a flavorant. The aerosol precursor material can be applied to the carbonized substrate by any suitable means. In certain embodiments, the aerosol precursor material can be coated on, adsorbed by, or absorbed in the carbonized substrate.

Further to the above, the resistive heating element can take on a variety of specific combinations of materials. For example, in certain embodiments, the resistive heating element can be formed of 1) a substrate comprising: an electrically conductive material selected from the group consisting of graphite, metal particles, and combinations thereof milled carbon; tobacco; and at least one polysaccharide; wherein the substrate is carbonized; and 2) a polyhydric alcohol aerosol precursor material associated with the carbonized substrate. Preferably, such resistive heating element has an electrical resistance of about 15 ohms or less. As another example, the resistive heating element can be formed of 1) a substrate comprising: an electrically conductive material selected from the group consisting of graphite, metal particles, and combinations thereof; and at least one polysaccharide; wherein the substrate is carbonized; and 2) an aerosol precursor material associated with the carbonized substrate, the aerosol precursor material comprising a polyhydric alcohol and an inhalable substance. Again, such resistive heating element preferably has an electrical resistance of about 15 ohms or less.

The resistive heating element can take on a variety of physical shapes and dimensions. In certain embodiments, the heating element can be elongated and can have a length of about 5 mm to about 40 mm. More particularly, the heating element can be substantially rod shaped and can, for example, have a mean diameter of about 0.5 mm to about 5 mm. In some embodiments, the resistive heating element can be elongated and have a non-uniform cross-sectional geometry. In alternate embodiments, the resistive heating element can be formed of an electrically conductive material provided as a core that is substantially surrounded by a material formed of a carbonaceous additive. Similarly, the resistive heating element can be formed such that the electrically conductive material is in the form of a sheath that substantially surrounds a core comprising at least one carbonaceous additive. In some embodiments, the substrate of the resistive heating element can be characterized as being an extrudate. Alternately, the substrate can be in a non-extruded form. For example, the substrate can be substantially pelletized or particulate. The substrate also can be in the form of a sheet, which can particularly be a rolled sheet. The substrate further can be substantially chip-shaped in that it is flattened with a defined length, width, and thickness (e.g., the thickness being less than one or both of the width and thickness). The substrate also can be substantially disc-shaped. In some embodiments, the conductive substrate can be provided in connection with a substrate support frame. For example, the substrate can be substantially suspended within the support frame or the substrate can be deposited on the support frame. In exemplary embodiments, the substrate support frame can have a cross-section that includes a linear portion (e.g., a straight line, an X-shape, a Y-shape, or the like). Moreover, the support frame can include a component that forms an electrical connection with a power source.

As noted above, the resistive heating element is particularly useful as a component of a smoking article. As such, in another aspect, the invention can provide smoking articles. In one embodiment, a smoking article according to the invention can generally comprise a resistive heating element as otherwise described herein in electrical connection with an electrical power source. In particular embodiments, the resistive heating element and the electrical power source can be removably connected. For example, the resistive heating element can be housed in a first shell that is removably attached to a second shell that houses the electrical power source. Each shell can separately include further components for facilitating the electrical connection.

The electrical power source of the smoking article can encompass any power source that provides sufficient electrical power to heat the resistive heating element to form an aerosol and can be, for example, selected from the group consisting of a battery, a capacitor, and combinations thereof. The smoking article also can include any variety of means for charging or recharging the electrical power source.

The smoking article further can comprise a control component that actuates current flow from the electrical power source to the resistive heating element. For example, such control component can comprise a puff-actuated sensor, a pushbutton, a capacitive sensor, or the like, or some combination of such components. Likewise, the smoking article can comprise a component that regulates a previously initiated current flow from the electrical power source to the resistive heating element. For example, the current regulating component can be a time-based component. In specific embodiments, the current regulating component can be functional to stop current to the resistive heating element once a defined temperature has been achieved. In other embodiments, the current regulating component can function to cycle the current to the resistive heating element off and on once a defined temperature has been achieved so as to maintain the defined temperature for a defined period of time. More specifically, the current regulating component can cycle the current to the resistive heating element off and on to maintain a first temperature that is below an aerosol forming temperature and allow an increased current flow in response to a current actuation control component so as to achieve a second temperature that is greater than the first temperature and that is an aerosol forming temperature. As exemplary embodiments, such first temperature can be about 50° C. to about 110° C., and such second temperature can be about 120° C. to about 300° C. In further embodiments, a smoking article according to the invention can comprise a plurality of control components, including a stand-alone control component, a control component integral with a battery, a control component integral with a sensor, or the like.

As already noted above, a smoking article according to the invention can comprise a plurality of units that are engagable and disengageable from one another. In certain embodiments, a smoking article thus can comprise a first unit that is engagable and disengageable with a second unit, the first unit comprising the resistive heating element, and the second unit comprising the electrical power source. The second unit further can comprise one or more control components that actuate or regulate current flow from the electrical power source. Moreover, the first unit can comprise a distal end that engages the second unit and an opposing, proximate end (i.e., a mouthend) with an opening at a proximate end thereof. Such first unit can include an optional mouthpiece that can attach to the mouthend and can be shaped as desired. Still further, the first unit can comprise an air flow path providing for passage of aerosol formed from the resistive heating element out of the mouthend of the first unit. In specific embodiments, the first unit can be disposable.

In further embodiments, the smoking article can be formed of a single shell, which can optionally include a removable mouthend. In such embodiments, a removable and replaceable resistive heating element can be used and can be inserted and removed through the removable mouthend. In such embodiments, it can be useful for the resistive heating element to include a substrate support frame.

In another aspect, the invention can provide a kit for accommodating a smoking article, or components thereof. In certain embodiments, a kit according to the invention can comprise a case that accommodates one or more further kit components; one or more disposable units for use with a reusable smoking article, the disposable unit comprising cartridge body with a distal end configured to engage a component of a reusable smoking article and an opposing, proximate end that includes a mouthpiece with an opening at a proximate end thereof, each of the one or more disposable units comprising a resistive heating element as otherwise discussed herein disposed within the cartridge body; and optionally one or more components selected from the group consisting of a reusable control unit, a battery, and a charging component. More specifically, the reusable control unit in a kit according to the invention can comprise: a control housing including an engaging end for engaging the distal end of the cartridge body of the disposable unit; an electrical power source disposed within the control housing; and one or more control components disposed within the control housing, the one or more control components being configured to actuate or regulate current flow from the electrical power source.

In another aspect, the invention further provides methods of preparing a resistive heating element as disclosed herein, such resistive heating element particularly being configured for use in a smoking article. In certain embodiments, a method of preparing a resistive heating element can comprise combining an electrically conductive material with at least one carbonaceous additive to form an intermediate substrate, heating the intermediate substrate for a defined period of time at a temperature of about 200° C. or greater to form a carbonized substrate, and associating an aerosol precursor material with the carbonized substrate to form the resistive heating element.

In particular embodiments, the step of combining the materials can comprise mixing for a defined time, such as a time of about 5 minutes or greater. Mixing also can comprise adding a liquid such that the intermediate substrate has a moisture content of about 15% or greater.

After combining the materials, the method also can comprise forming the intermediate substrate into a defined shape. For example, the forming step can comprise extruding the intermediate substrate to form an extrudate. More generally, the forming step can comprise forming the intermediate substrate into an elongated form. The elongated substrate then can be processed into defined lengths, such as a length of about 2.5 mm to about 60 mm. The forming step also can be characterized as forming the intermediate substrate into a form that is substantially as otherwise described herein in relation to the nature of the resistive heating element itself. For example, the method can comprise any of the following: forming the intermediate substrate into a form that is elongated and has a non-uniform cross-sectional geometry; forming the substrate into pellets; forming the substrate as a sheet; rolling a formed sheet; providing the electrically conductive material in the form of a core that is substantially surrounded by the at least one carbonaceous additive; and providing the electrically conductive material in the form of a sheath that substantially surrounds a core comprising the at least one carbonaceous additive.

Heating of the intermediate substrate can be carried out in any suitable apparatus, such as a vacuum oven or a muffle furnace. Heating—i.e., calcining—at an increased temperature can be useful to improve the resistance of the material. It can be preferable for the calcination temperature to be about 200° C. to about 1,200° C., about 250° C. to about 1,000° C., or about 300° C. to about 900° C. In some embodiments, it can be preferable for heating to be carried out in an inert atmosphere, such as under a nitrogen atmosphere.

Any useful method can be utilized to associate the aerosol precursor material with the carbonized substrate. For example, the associating step can comprise coating, adsorbing, or absorbing the aerosol precursor material on or in the carbonized substrate.

In some embodiments, a method of forming a resistive heating element can include attaching the resistive heating element to a support frame. For example, the resistive heating element can be substantially suspended within the support frame, or the resistive heating element can be deposited on a surface of the support frame.

In still another aspect, the invention encompasses methods of forming an aerosol. In certain embodiments, a method of forming an aerosol can comprise placing a resistive heating element as otherwise described herein into electrical connection with an electrical power source. For example, the electrical power source can be an electronic smoking article.

BRIEF DESCRIPTION OF THE FIGURES

Figure 1:
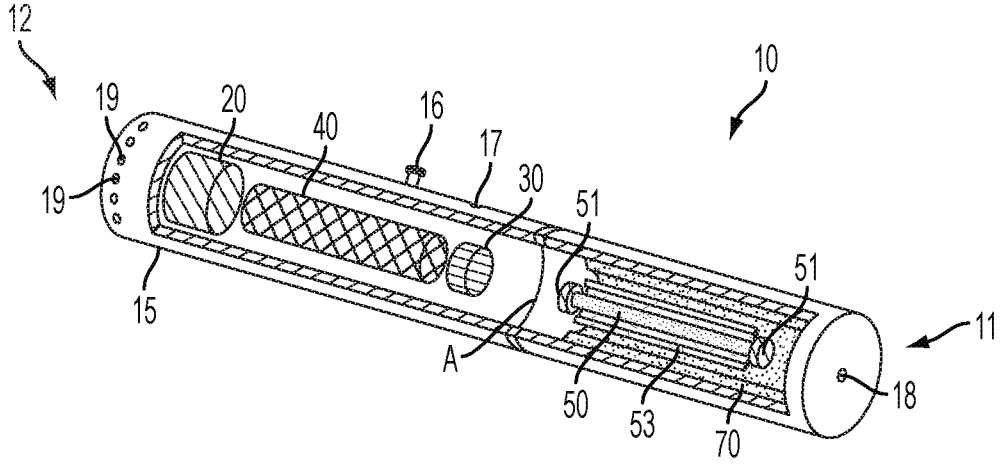
Figure 2:
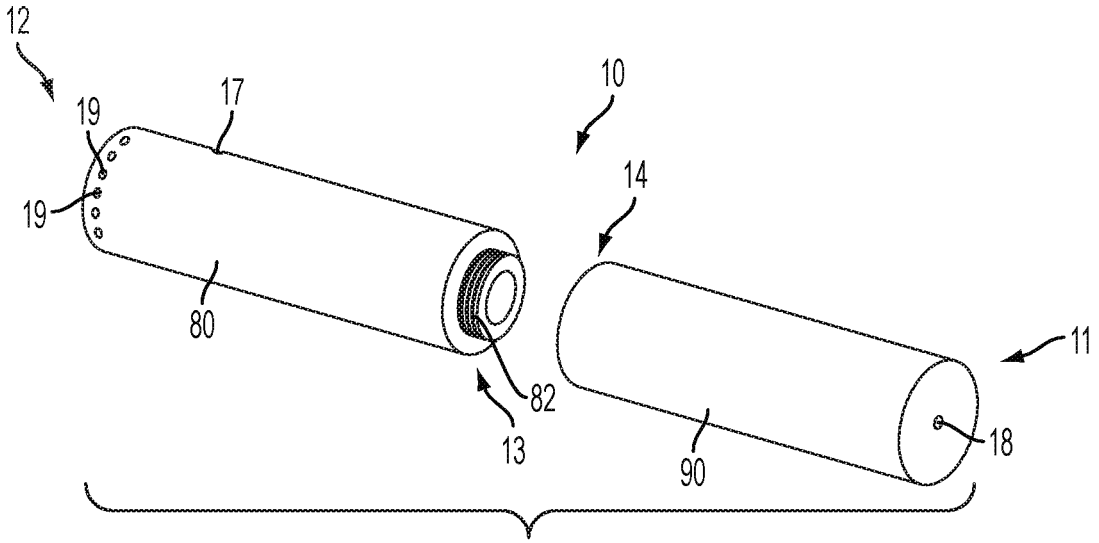
Figure 3:
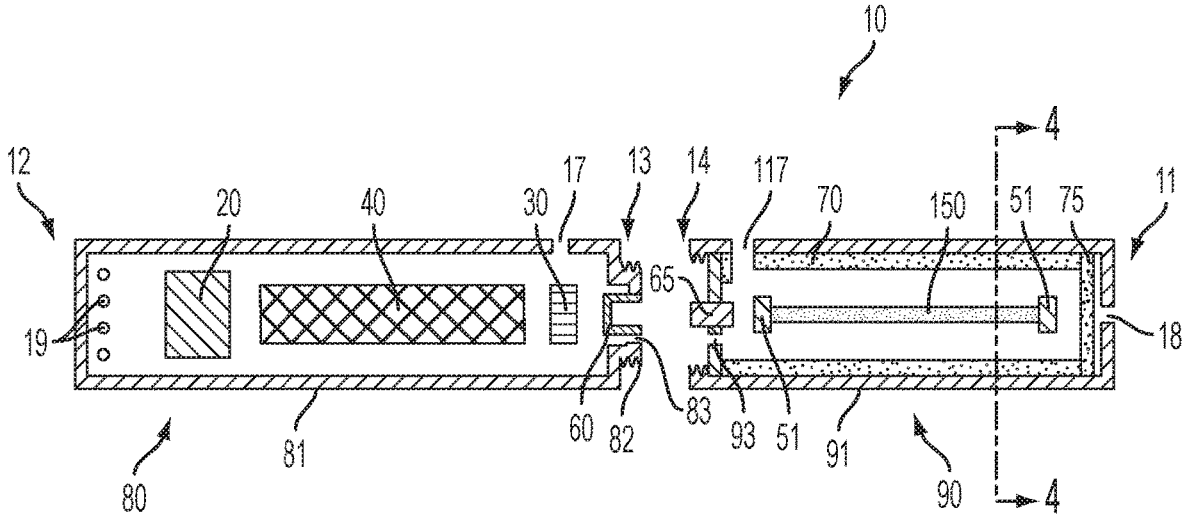
Figure 4A:
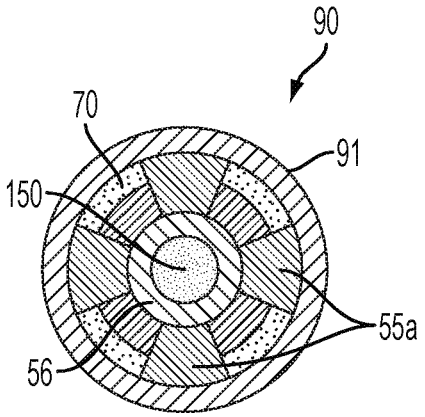
Figure 4B:
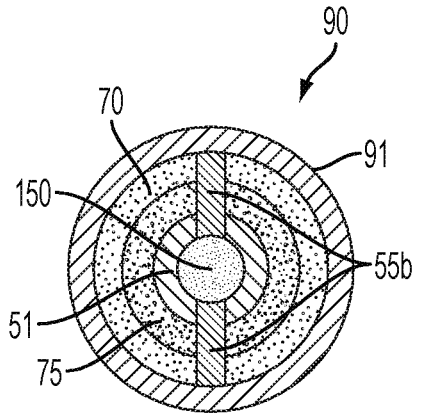
Figure 5A:
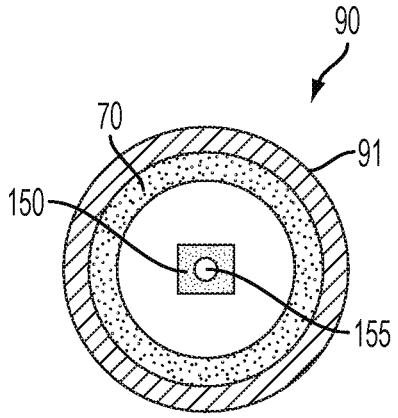
Figure 5B:
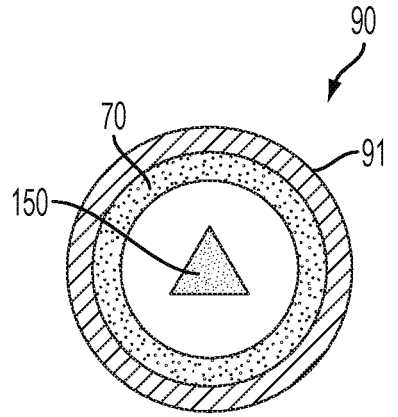
Figure 5C:
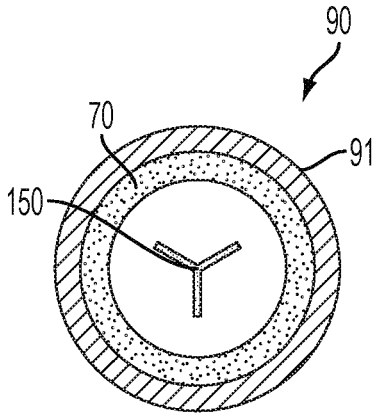
Figure 5D:
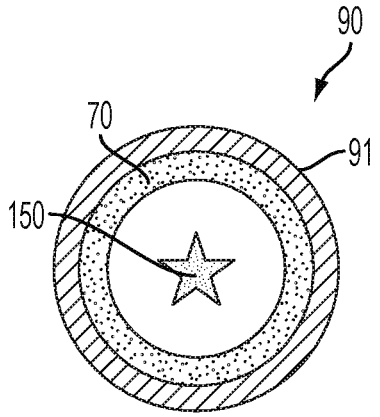
Figure 5E:
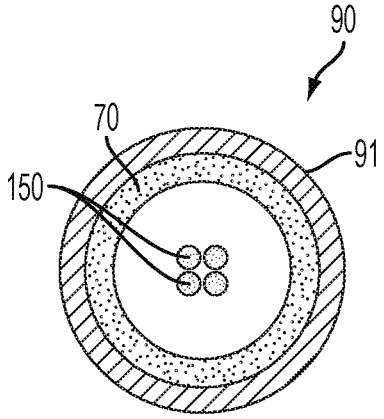
Figure 5F:
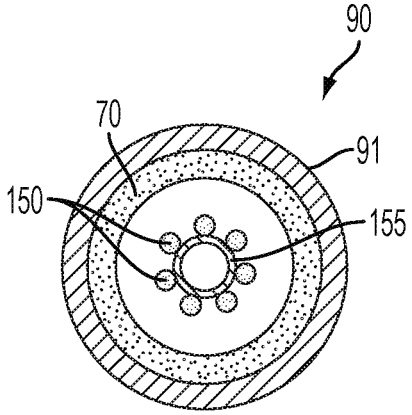
Figure 5G:
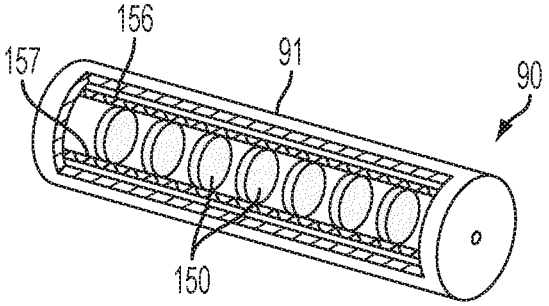
Figure 6:
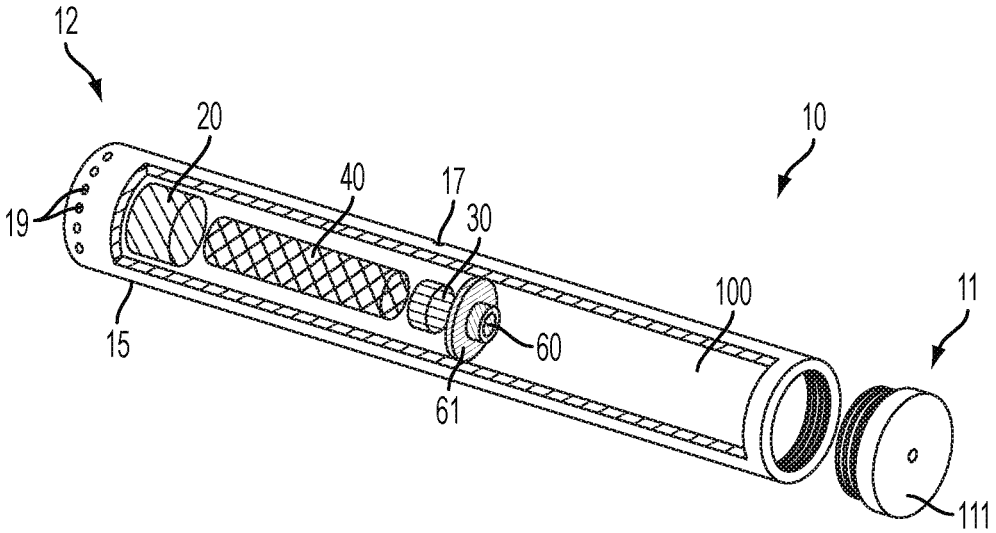
Figure 7A:
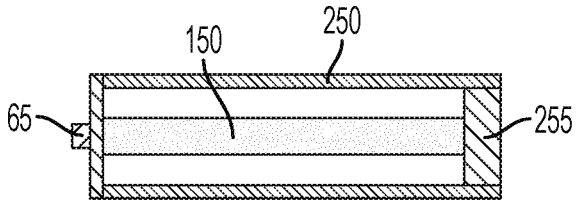
Figure 7B:
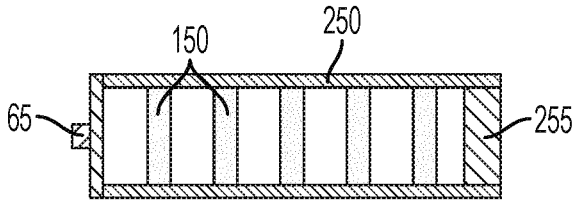
Figure 7C:
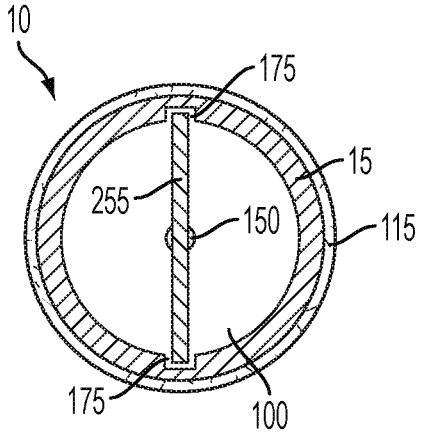
Figure 7D:
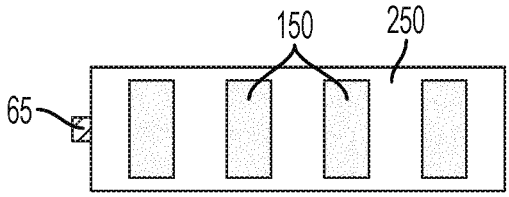
Figure 7E:
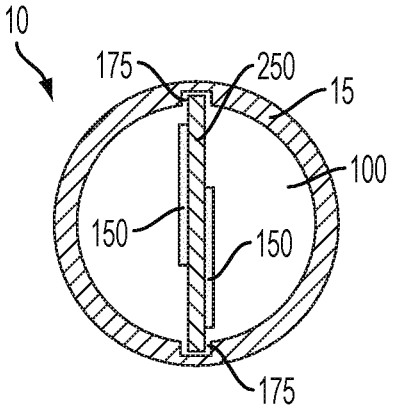
Figure 7F:
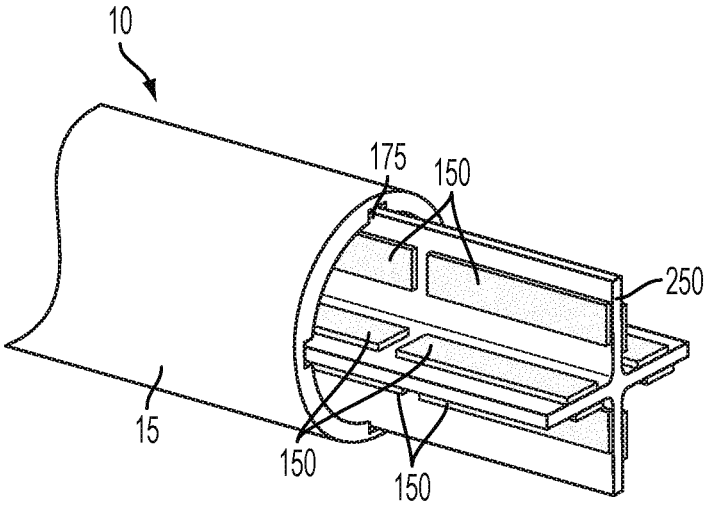
Figure 7G:
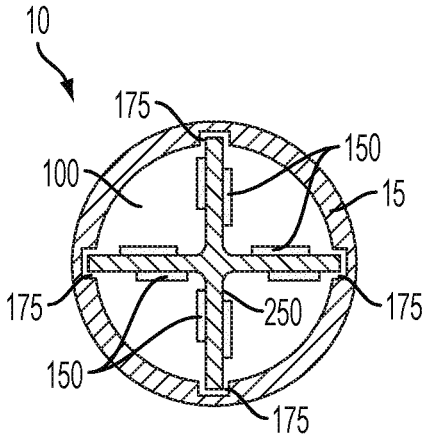

Having thus described the invention in the foregoing general terms, reference will now be made to the accompanying drawings, which are not necessarily drawn to scale, and wherein:

FIG. 1 is a perspective view of an example embodiment of a smoking article according to the invention, wherein a portion of an outer shell of the article is cut away to reveal the interior components thereof;

FIG. 2 is a perspective view of an example embodiment of a smoking article according to the invention, wherein the article comprises a control body and a cartridge that are attachable and detachable therefrom;

FIG. 3 is a longitudinal cross-section of a smoking article according to an example embodiment of the invention;

FIG. 4*a* is a cross-section along line 4 from FIG. 3 showing an example embodiment of means for positioning a resistive heating element within a cartridge according to the invention;

FIG. 4*b* is a cross-section along line 4 from FIG. 3 showing an alternative example embodiment of means for positioning a resistive heating element within a cartridge according to the invention;

FIG. 5*a* through FIG. 5*f* are cross-sections of a cartridge illustrating exemplary embodiments of a single, unitary conductive substrate or a plurality of individual conductive substrates provided within the cartridge;

FIG. 5*g* is a perspective view of an example embodiment of a cartridge for a smoking article according to the invention, wherein a portion of an outer shell of the cartridge is cut away to reveal a plurality of individual conductive substrates serially arranged within the cartridge;

FIG. 6 is a perspective view of an example embodiment of a smoking article according to the invention, wherein the article comprises a plurality of permanent components therein and a cavity for receiving a removable and replaceable conductive substrate;

FIG. 7*a* illustrates an exemplary embodiment of a conductive substrate within a substrate support frame that facilitates insertion and withdrawal of the conductive substrate into and from a smoking article according to the invention;

FIG. 7*b* illustrates an exemplary embodiment of a plurality of conductive substrates within a substrate support frame that facilitates insertion and withdrawal of the conductive substrates into and from a smoking article according to the invention;

FIG. 7*c* is a cross-section of a smoking article according to an exemplary embodiment illustrating a combined conductive substrate and substrate support frame inserted into a cavity in the smoking article;

FIG. 7*d* illustrates an exemplary embodiment of a plurality of chips conductive substrates positioned on a substrate support frame that facilitates insertion and withdrawal of the conductive substrate into and from a smoking article according to the invention;

FIG. 7*e* is a cross-section of a smoking article according to an exemplary embodiment illustrating a combined conductive substrate and substrate support frame inserted into a cavity in the smoking article;

FIG. 7*f* is a partial perspective view of an example embodiment of a smoking article according to the invention having partially inserted in a cavity therein a combined conductive substrate and substrate support frame according to an embodiment of the invention; and FIG. 7*g* is a cross-section of a smoking article according to an exemplary embodiment illustrating a combined conductive substrate and substrate support frame inserted into a cavity in the smoking article.

DETAILED DESCRIPTION OF THE INVENTION

The present invention will now be described more fully hereinafter with reference to exemplary embodiments thereof. These exemplary embodiments are described so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without substantial combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article, drawing on one end of the article, and inhaling from the article. In further embodiments, the inventive articles can be characterized as being vapor-producing articles, aerosolization articles, or medicament delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather may depend upon the nature of the medium and the inhalable substance itself as to whether it exists in a vapor state or an aerosol state. In some embodiments, the terms may be interchangeable. Thus, for simplicity, the terms as used to describe the invention are understood to be interchangeable unless stated otherwise.

In one aspect, the present invention provides a smoking article. The smoking article generally can include a number of components provided within an elongated body, which can be a single, unitary shell or which can be formed of two or more separable pieces. For example, a smoking article according to one embodiment can comprise a shell (i.e., the elongated body) that can be substantially tubular in shape, such as resembling the shape of a conventional cigarette or cigar. Within the shell can reside all of the components of the smoking article. In other embodiments, a smoking article can comprise two shells that are joined and are separable. For example, a control body can comprise a shell containing one or more reusable components and having an end that removably attaches to a cartridge. The cartridge can comprise a shell containing one or more disposable components and having an end that removably attaches to the control body. More specific arrangements of components within the single shell or within the separable control body and cartridge are evident in light of the further disclosure provided herein.

Smoking articles useful according to the invention particularly can comprise some combination of a power source (i.e., an electrical power source), one or more control components (e.g., to control/actuate/regulate flow of power from the power source to one or more further components of the article), a heater component, and an aerosol generating component. The smoking article further can include a defined air flow path through the article such that aerosol generated by the article can be withdrawn therefrom by a user drawing on the article. Alignment of the components within the article can vary. In specific embodiments, the aerosol generating component can be located near an end of the article that is proximal to the mouth of a user so as to maximize aerosol delivery to the user. Other configurations, however, are not excluded. Generally, the heater component can be positioned sufficiently near that aerosol generating component so that heat from the heater component can volatilize an aerosol precursor material carried by the aerosol generating material (as well as one or more flavorants, medicaments, or the like that may likewise be provided for delivery to a user) and form an aerosol for delivery to the user. When the heating member heats the aerosol generating component, an aerosol (alone or including a further inhalable substance) is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

A smoking article according to the invention generally can include an electrical power source (or electrical power source) to provide current flow sufficient to provide various functionalities to the article, such as resistive heating, powering of indicators, and the like. The power source for the inventive smoking article can take on various embodiments. Preferably, the power source is able to deliver sufficient power to rapidly heat the heating member to provide for aerosol formation and power the article through use for the desired duration of time. The power source preferably is sized to fit conveniently within the article. Examples of useful power sources include lithium ion batteries that preferably are rechargeable (e.g., a rechargeable lithium-manganese dioxide battery). In particular, lithium polymer batteries can be used as such batteries can provide increased safety. Other types of batteries—e.g., N50-AAA CADNICA nickel-cadmium cells—may also be used. Even further examples of batteries that can be used according to the invention are described in US Pub. App. No. 2010/0028766, the disclosure of which is incorporated herein by reference in its entirety. Thin film batteries may be used in certain embodiments of the invention. Any of these batteries or combinations thereof can be used in the power source, but rechargeable batteries are preferred because of cost and disposal considerations associated with disposable batteries. In embodiments wherein disposable batteries are provided, smoking article can include access for removal and replacement of the battery. Alternatively, in embodiments where rechargeable batteries are used, the smoking article can comprise charging contacts, for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the smoking article. The article further can include components for providing a non-contact inductive recharging system such that the article can be charged without being physically connected to an external power source. Thus, the article can include components to facilitate transfer of energy from an electromagnetic field to the rechargeable battery within the article.

In further embodiments, the power source also can comprise a capacitor. Capacitors are capable of discharging more quickly than batteries and can be charged between puffs, allowing the battery to discharge into the capacitor at a lower rate than if it were used to power the heating member directly. For example, a supercapacitor—i.e., an electric double-layer capacitor (EDLC)—may be used separate from or in combination with a battery. When used alone, the supercapacitor may be recharged before each use of the article. Thus, the invention also may include a charger component that can be attached to the smoking article between uses to replenish the supercapacitor.

The smoking article can further include a variety of power management software, hardware, and/or other electronic control components. For example, such software, hardware, and/or electronic controls can include carrying out charging of the battery, detecting the battery charge status, performing power save operations, preventing unintentional or over-discharge of the battery, or the like.

A "controller" or "control component" according to the present invention can encompass a variety of elements useful in the present smoking article. Moreover, a smoking article according to the invention can include one, two, or even more control components that can be combined into a unitary element or that can be present at separate locations within the smoking article, and individual control components can be utilized for carrying out different control aspects. For example, a smoking article can include a control component that is integral to or otherwise combined with a battery so as to control power discharge from the battery. The smoking article separately can include a control component that controls other aspects of the article. Alternatively, a single controller may be provided that carries out multiple control aspects or all control aspects of the article. Likewise, a sensor (e.g., a puff sensor) used in the article can include a control component that controls the actuation of power discharge from the power source in response to a stimulus. The smoking article separately can include a control component that controls other aspects of the article. Alternatively, a single controller may be provided in or otherwise associated with the sensor for carrying out multiple control aspects or all control aspects of the article. Thus, it can be seen that a variety of combinations of controllers may be combined in the present smoking article to provide the desired level of control of all aspects of the device.

The smoking article also can comprise one or more controller components useful for controlling flow of electrical energy from the power source to further components of the article, such as to a resistive heating element. Specifically, the article can comprise a control component that actuates current flow from the power source, such as to the resistive heating element. For example, in some embodiments, the article can include a pushbutton that can be linked to a control circuit for manual control of power flow. For example, a consumer can use the pushbutton to turn on the article and/or to actuate current flow into the resistive heating element. Multiple buttons can be provided for manual performance of powering the article on and off, and for activating heating for aerosol generation. One or more pushbuttons present can be substantially flush with an outer surface of the smoking article.

Instead of (or in addition to) the pushbutton, the inventive article can include one or more control components responsive to the consumer's drawing on the article (i.e., puff-actuated heating). For example, the article may include a switch that is sensitive either to pressure changes or air flow changes as the consumer draws on the article (i.e., a puff-actuated switch). Other suitable current actuation/deactuation mechanisms may include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. With such sensor, the resistive heating element can be activated rapidly by a change in pressure when the consumer draws on the article. In addition, flow sensing devices, such as those using hot-wire anemometry principles, may be used to cause the energizing of the resistive heating element sufficiently rapidly after sensing a change in air flow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a heating circuit according to the present invention are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and an air flow passage within the smoking article can be included so that pressure changes during draw are readily identified by the switch.

Capacitive sensing components in particular can be incorporated into the device in a variety of manners to allow for diverse types of "power-up" and/or "power-down" for one or more components of the device. Capacitive sensing can include the use of any sensor incorporating technology based on capacitive coupling including, but not limited to, sensors that detect and/or measure proximity, position or displacement, humidity, fluid level, pressure, or acceleration. Capacitive sensing can arise from electronic components providing for surface capacitance, projected capacitance, mutual capacitance, or self capacitance. Capacitive sensors generally can detect anything that is conductive or has a dielectric different than that of air. Capacitive sensors, for example, can replace mechanical buttons with capacitive alternatives. Thus, one specific application of capacitive sensing according to the invention is a touch capacitive sensor. For example, a touch pad can be present on the smoking article that allows the user to input a variety of commands. Most basically, the touch pad can provide for powering the heating element much in the same manner as a push button, as already described above. In other embodiments, capacitive sensing can be applied near the mouthend of the smoking article such that the pressure of the lips on the smoking article to draw on the article can signal the device to provide power to the heating element. In addition to touch capacitance sensors, motion capacitance sensors, liquid capacitance sensors, and accelerometers can be utilized according to the invention to illicit a variety of response from the smoking article. Further, photoelectric sensors also can be incorporated into the inventive smoking article.

Sensors utilized in the present articles can expressly signal for power flow to the heating element so as to heat the substrate including the aerosol precursor material and form a vapor or aerosol for inhalation by a user. Sensors also can provide further functions. For example, a "wake-up" sensor can be included. In particular embodiments, a smoking article can be packaged in a "sleep" mode such that power from the power source cannot be delivered to the heating element (or other components of the article if desired). The smoking article can include a sensor, such as a photoelectric sensor or a pull-tab activated sensor or even a capacitive sensor, such that after the smoking article is unpackaged, activation of the sensor moves the article from the sleep mode to a working mode wherein the article can be used as otherwise described herein. For example, the smoking article may be packaged such that light is substantially prevented from reaching the smoking article. A photoelectric sensor on the article then would function to detect when the article is removed from the packaging—i.e., is subject to ambient lighting—and transition the article from the sleep mode to a working mode. Likewise, the sensor can function such that when the article is again protected from ambient lighting—e.g., placed in a carrying case or storage case—the article reverts to the sleep mode as a safety measure. Other sensing methods providing similar function likewise can be utilized according to the invention.

When the consumer draws on the mouth end of the smoking article, the current actuation means can permit unrestricted or uninterrupted flow of current through the resistive heating member to generate heat rapidly. Because of the rapid heating, it can be useful to include current regulating components to (i) regulate current flow through the heating member to control heating of the resistive element and the temperature experienced thereby, and (ii) prevent overheating and degradation of the substrate or other component carrying the aerosol precursor material and/or other flavors or inhalable materials.

The current regulating circuit particularly may be time based. Specifically, such a circuit includes a means for permitting uninterrupted current flow through the heating element for an initial time period during draw, and a timer means for subsequently regulating current flow until draw is completed. For example, the subsequent regulation can include the rapid on-off switching of current flow (e.g., on the order of about every 1 to 50 milliseconds) to maintain the heating element within the desired temperature range. Further, regulation may comprise simply allowing uninterrupted current flow until the desired temperature is achieved then turning off the current flow completely. The heating member may be reactivated by the consumer initiating another puff on the article (or manually actuating the push-button, depending upon the specific switch embodiment employed for activating the heater). Alternatively, the subsequent regulation can involve the modulation of current flow through the heating element to maintain the heating element within a desired temperature range. In some embodiments, so as to release the desired dosing of the inhalable substance, the heating member may be energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. One exemplary time-based current regulating circuit can include a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits and other control components that can be useful in the present smoking article are provided in U.S. Pat. Nos. 4,922,901, 4,947,874, and 4,947,875, all to Brooks et al., all of which are incorporated herein by reference in their entireties.

The control components particularly can be configured to closely control the amount of heat provided to the resistive heating element. In some embodiments, the current regulating component can function to stop current flow to the resistive heating element once a defined temperature has been achieved. Such defined temperature can be in a range that is substantially high enough to volatilize the aerosol precursor material and any further inhalable substances and provide an amount of aerosol equivalent to a typical puff on a conventional cigarette, as otherwise discussed herein. While the heat needed to volatilize the aerosol precursor material in a sufficient volume to provide a desired volume for a single puff can vary, it can be particularly useful for the heating member to heat to a temperature of about 120° C. or greater, about 130° C. or greater, about 140° C. or greater, or about 160° C. In some embodiments, in order to volatilize an appropriate amount of the aerosol precursor material, the heating temperature may be about 180° C. or greater, about 200° C. or greater, about 300° C. or greater, or about 350° C. or greater. In further embodiments, the defined temperature for aerosol formation can be about 120° C. to about 350° C., about 140° C. to about 300° C., or about 150° C. to about 250° C. It can be particularly desirable, however, to avoid heating to temperatures substantially in excess of about 550° C. in order to avoid degradation and/or excessive, premature volatilization of the aerosol precursor material and/or other construction materials. Heating specifically should be at a sufficiently low temperature and for a sufficiently short time so as to avoid degradation and/or significant combustion (preferably any combustion) of the substrate or other component of the article. The duration of heating can be controlled by a number of factors, as discussed in greater detail hereinbelow. Heating temperature and duration may depend upon the desired volume of aerosol and ambient air that is desired to be drawn through the article. The duration, however, may be varied depending upon the heating rate of the resistive heating element, as the article may be configured such that the resistive heating element is energized only until a desired temperature is reached. Alternatively, duration of heating may be coupled to the duration of a puff on the article by a consumer. Generally, the temperature and time of heating will be controlled by one or more components contained in the control housing, as noted above.

The current regulating component likewise can cycle the current to the resistive heating element off and on once a defined temperature has been achieved so as to maintain the defined temperature for a defined period of time. Such rapid on-off cycling can be as already discussed above, and the defined temperature can be an aerosol generating temperature as noted above.

Still further, the current regulating component can cycle the current to the resistive heating element off and on to maintain a first temperature that is below an aerosol forming temperature and then allow an increased current flow in response to a current actuation control component so as to achieve a second temperature that is greater than the first temperature and that is an aerosol forming temperature. Such controlling can improve the response time of the article for aerosol formation such that aerosol formation begins almost instantaneously upon initiation of a puff by a consumer. In some embodiments, the first temperature (which can be characterized as a standby temperature) can be only slightly less than the aerosol forming temperature defined above. Specifically, the standby temperature can be about 50° C. to about 150° C., about 70° C. to about 140° C., about 80° C. to about 120° C., or about 90° C. to about 110° C.

In light of the foregoing, it can be seen that a variety of mechanisms can be employed to facilitate actuation/deactuation of current to the resistive heating element and to other components of the smoking article. Specifically the article can comprise a component that regulates a previously initiated current flow from the electrical power source to the resistive heating element. For example, the inventive article can comprise a timer (i.e., a time-based component) for regulating current flow in the article (such as during draw by a consumer). The article further can comprise a timer responsive switch that enables and disables current flow to the resistive heating element. Current flow regulation also can comprise use of a capacitor and components for charging and discharging the capacitor at a defined rate (e.g., a rate that approximates a rate at which the heating member heats and cools). Current flow specifically may be regulated such that there is uninterrupted current flow through the heating member for an initial time period during draw, but the current flow may be turned off or cycled alternately off and on after the initial time period until draw is completed. Such cycling may be controlled by a timer, as discussed above, which can generate a preset switching cycle. In specific embodiments, the timer may generate a periodic digital wave form. The flow during the initial time period further may be regulated by use of a comparator that compares a first voltage at a first input to a threshold voltage at a threshold input and generates an output signal when the first voltage is equal to the threshold voltage, which enables the timer. Such embodiments further can include components for generating the threshold voltage at the threshold input and components for generating the threshold voltage at the first input upon passage of the initial time period.

In addition to the above control elements, the smoking article also may comprise one or more indicators. Such indicators may be lights (e.g., light emitting diodes) that can provide indication of multiple aspects of use of the inventive article. For example, a series of lights may correspond to the number of puffs for a given cartridge of the smoking article. Specifically, the lights may become lit with each puff indicating to a consumer that the cartridge was completely used when all lights were lit. Alternatively, all lights may be lit upon the initial loading of the cartridge, and a light may turn off with each puff indicating to a consumer that the cartridge was completely used when all lights were off. In still other embodiments, only a single indicator may be present, and lighting thereof can indicate that current is flowing to the resistive heating element and the article is actively heating. This may ensure that a consumer does not unknowingly leave an article unattended in an actively heating mode. Still further, one or more indicators can be provided as an indicator of battery status—e.g., battery charge, low battery, battery charging, or the like. Although the indicators are described above in relation to visual indicators in an on/off method, other indices of operation also are encompassed. For example, visual indicators also may include changes in light color or intensity to show progression of the smoking experience. Tactile indicators and sound indicators similarly are encompassed by the invention. Moreover, combinations of such indicators also may be used in a single article.

A smoking article according to the invention further can comprise an aerosol forming component and a heating member that heats the aerosol forming component to produce an aerosol for inhalation by a user. The present invention particularly can be characterized in relation to the provision of a heating member and an aerosol forming component that are integrally formed into a single resistive heating element. In particular, the invention can provide a resistive heating element comprising a substrate including an electrically conductive material and at least one carbonaceous additive, and also including an aerosol precursor material associated with the substrate. More particularly, the substrate is carbonized. Preferably, the resistive heating element exhibits an electrical resistance below a defined value, as otherwise described herein, thus making the resistive heating element useful for providing a sufficient quantity of heat when electrical current flows therethrough.

Electrically conductive materials useful as resistive heating elements can be those having low mass, low density, and moderate resistivity and that are thermally stable at the temperatures experienced during use. Useful heating elements heat and cool rapidly, and thus provide for the efficient use of energy. Rapid heating of the element can be beneficial to provide almost immediate volatilization of an aerosol precursor material in proximity thereto. Rapid cooling prevents substantial volatilization (and hence waste) of the aerosol precursor material during periods when aerosol formation is not desired. Such heating elements also permit relatively precise control of the temperature range experienced by the aerosol precursor material, especially when time based current control is employed. Useful electrically conductive materials preferably are chemically non-reactive with the materials being heated (e.g., aerosol precursor materials and other inhalable substance materials) so as not to adversely affect the flavor or content of the aerosol or vapor that is produced. Exemplary, non-limiting, materials that can be used as the electrically conductive material include carbon, graphite, carbon/graphite composites, metals, metallic and non-metallic carbides, nitrides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. More generally, the electrically conductive material can be characterized in relation to its electrical conductivity (or specific conductance), which is the reciprocal of the material's electrical resistivity (or specific resistance). Electrical conductivity can be quantified in units of mho/meter (i.e., the reciprocal of the resistivity in ohms) or Siemens/meter as represented by the symbol sigma ($\sigma$). Specifically, a useful electrically conductive material can have an electrical conductivity on the order of $10^1$ $\sigma$ or greater, $10^2$ $\sigma$ or greater, or $10^3$ $\sigma$ or greater. For example, graphite has an electrical conductivity of about $3\times10^2$ to about $3\times10^5$ $\sigma$ depending upon its basal plane.

The present invention particularly can be characterized in that a resistive heating element can comprise a substrate formed of two or more integral components. In particular, the substrate can comprise an electrically conductive material, such as discussed above, in combination with one or more substrate additives. As more fully discussed below, such substrate additives can comprise materials useful for providing inhalable components to be delivered to a user by the smoking article, materials useful for providing bulk, binding, or other specific properties to the substrate, and materials useful for facilitating aerosol formation. Thus, the substrate can be substantially a solid mass comprising the electrically conductive material. The electrically conductive material thus preferably may be present in a form that facilitates combination with one or more further materials to form the substrate.

In specific embodiments, the electrically conductive material can be in a particulate form. For example, the electrically conductive material can have an average particle size of up to about 2 mm, up to about 1 mm, up to about 750 μm, up to about 500 μm. In other embodiments, the particles can have an average size of about 1 nm to about 2 mm, about 50 nm to about 1.5 mm, about 0.1 μm to about 1 mm, about 0.5 μm to about 500 μm, or about 1 μm to about 100 μm. In further embodiments, the electrically conductive material can be substantially rod shaped particles. For example, the electrically conductive rod-shaped particles can have a diameter of up to about 1 mm, up to about 750 μm, up to about 500 μm, or up to about 250 μm. Further, the rods can have a diameter of about 0.1 μm to about 1 mm, about 0.25 μm to about 500 μm, about 0.5 μm to about 250 μm, or about 1 μm to about 100 μm. Electrically conductive rod-shaped particles can have a length of up to about 10 mm, up to about 5 mm, up to about 2 mm, up to about 1 mm, or up to about 750 μm. Further, the rod-shaped particles can have a length of about 0.5 μm to about 10 mm, about 1 μm to about 5 mm, about 2 μm to about 1 mm, or about 5 μm to about 500 μm. The electrically conductive material further can be provided in additional forms, such as in the form of a foil, a foam, discs, spirals, fibers, wires, films, yarns, strips, ribbons, or cylinders, as well as irregular shapes of varying dimensions.

In addition to the electrically conductive material, the substrate component of the resistive heating element can comprise at least one carbonaceous additive. The carbonaceous additive can provide multiple advantages. Specifically, as further discussed below, the carbonaceous additive can function as a lattice former in that the additive can be altered through specific processing steps to remove non-carbon components of the material and leave behind a carbon lattice, carbon skeleton, or carbon backbone type structure. In some embodiments, the carbonaceous additive can be a milled carbon.

In certain embodiments, the carbonaceous material used in the substrate can be tobacco, a tobacco component, or a tobacco-derived material (i.e., a material that is found naturally in tobacco that may be isolated directly from the tobacco or synthetically prepared). The tobacco that is employed can include, or can be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al., U.S. Pat. No. 7,011,096 to Li et al.; U.S. Pat. No. 7,017,585 to Li et al.; U.S. Pat. No. 7,025,066 to Lawson et al.; US Pat.

App. Pub. No. 2004/0255965 to Perfetti et al.; PCT Pub. WO 02/37990 to Bereman; and Bombick et al., Fund. Appl. Toxicol., 39, p. 11-17 (1997); the disclosures of which are incorporated herein by reference in their entireties. Descriptions of various types of tobaccos, growing practices, harvesting practices, and curing practices are set forth in Tobacco Production, Chemistry and Technology, Davis et al. (Eds.) (1999). Most preferably, the tobacco that is employed has been appropriately cured and aged. Especially preferred techniques and conditions for curing flue-cured tobacco are set forth in Nestor et al., Beitrage Tabakforsch. Int., (2003) 467-475 and U.S. Pat. No. 6,895,974 to Peele, which are incorporated herein by reference in their entireties. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference in their entireties.

The tobacco that is incorporated within the smoking article can be employed in various forms; and combinations of various forms of tobacco can be employed, or different forms of tobacco can be employed at different locations within the smoking article. For example, the tobacco can be employed in the form of cut or shredded pieces of lamina or stem; in a processed form (e.g., reconstituted tobacco sheet, such as pieces of reconstituted tobacco sheet shredded into a cut filer form; films incorporating tobacco components; extruded tobacco parts or pieces; expanded tobacco lamina, such as cut filler that has been volume expanded; pieces of processed tobacco stems comparable to cut filler in size and general appearance; granulated tobacco; foamed tobacco materials; compressed or pelletized tobacco; or the like); as pieces of finely divided tobacco (e.g., tobacco dust, tobacco powder, agglomerated tobacco powders, or the like); or in the form of a tobacco extract. See, for example, U.S. Pat. No. 7,647,932 to Cantrell et al. and US Pat. Pub. No. 2007/0215167 to Crooks et al., the disclosures of which are incorporated herein by reference in their entireties.

The smoking article can employ tobacco in the form of lamina and/or stem. As such, the tobacco can be used in forms, and in manners, that are virtually identical in many regards to those traditionally used for the manufacture of tobacco products, such as cigarettes. Traditionally, cut or shredded pieces of tobacco lamina and stem have been employed as so-called "cut filler" for cigarette manufacture. Pieces of water extracted stems also can be employed. As such, the tobacco in such a form introduces mass and bulk within the smoking article. Manners and methods for curing, de-stemming, aging, moistening, cutting, reordering and handling tobacco that is employed as cut filler will be apparent to those skilled in the art of tobacco product manufacture.

Processed tobaccos that can be incorporated within the smoking article can vary. Exemplary manners and methods for providing reconstituted tobacco sheet, including casting and paper-making techniques, are set forth in U.S. Pat. No. 4,674,519 to Keritsis et al.; U.S. Pat. No. 4,941,484 to Clapp et al.; U.S. Pat. No. 4,987,906 to Young et al.; U.S. Pat. No. 4,972,854 to Kiernan et al.; U.S. Pat. No. 5,099,864 to Young et al.; U.S. Pat. No. 5,143,097 to Sohn et al.; U.S. Pat. No. 5,159,942 to Brinkley et al.; U.S. Pat. No. 5,322,076 to Brinkley et al.; U.S. Pat. No. 5,339,838 to Young et al.; U.S. Pat. No. 5,377,698 to Litzinger et al.; U.S. Pat. No. 5,501,237 to Young; and U.S. Pat. No. 6,216,706 to Kumar; the disclosures of which is incorporated herein by reference in their entireties. Exemplary manners and methods for providing extruded forms of processed tobaccos are set forth in U.S. Pat. No. 4,821,749 to Toft et al.; U.S. Pat. No. 4,880,018 to Graves, Jr. et al.; U.S. Pat. No. 5,072,744 to Luke et al.; U.S. Pat. No. 4,874,000 to Tamol et al.; U.S. Pat. No. 5,551,450 to Hemsley; U.S. Pat. No. 5,649,552 to Cho et al.; U.S. Pat. No. 5,829,453 to White; U.S. Pat. No. 6,125,855 to Nevett et al.; and U.S. Pat. No. 6,182,670 to White; the disclosures of which are incorporated herein by reference in their entireties. Extruded tobacco materials can have the forms of cylinders, strands, discs, or the like. Exemplary expanded tobaccos (e.g., puffed tobaccos) can be provided using the types of techniques set forth in US Pat. No. Re 32,013 to de la Burde et al.; U.S. Pat. No. 3,771,533 to Armstrong et al.; U.S. Pat. No. 4,577,646 to Ziehn; U.S. Pat. No. 4,962,773 to White; U.S. Pat. No. 5,095,922 to Johnson et al.; U.S. Pat. No. 5,143,096 to Steinberg; U.S. Pat. No. 5,172,707 to Zambelli; U.S. Pat. No. 5,249,588 to Brown et al.; U.S. Pat. No. 5,687,748 to Conrad; U.S. Pat. No. 5,908,032 to Poindexter; and US Pat. Pub. 2004/0182404 to Poindexter et al.; the disclosures of which are incorporated herein by reference in their entireties. One particularly preferred type of expanded tobacco is dry ice expanded tobacco (DIET). Exemplary forms of processed tobacco stems include cut-rolled stems, cut-rolled-expanded stems, cut-puffed stems and shredded-steam expanded stems. Exemplary manners and methods for providing processed tobacco stems are set forth in U.S. Pat. No. 4,195,646 to Kite and U.S. Pat. No. 5,873,372 to Honeycutt et al., the disclosures of which are incorporated herein by reference in their entireties. Manners and methods for employing tobacco dust are set forth in U.S. Pat. No. 4,341,228 to Keritsis et al.; U.S. Pat. No. 4,611,608 to Vos et al.; U.S. Pat. No. 4,706,692 to Gellatly; and U.S. Pat. No. 5,724,998 to Gellatly et al.; the disclosures of which are incorporated herein by reference in their entireties. Yet other types of processed tobaccos are of the type set forth in US Pat. Pub. No. 2006/0162733 to McGrath et al., the disclosure of which is incorporated herein by reference in its entirety.

The tobacco can be used in a blended form. Typically, the blends of various types and forms of tobaccos are provided in a blended cut filler form. For example, certain popular tobacco blends for cigarette manufacture, commonly referred to as "American blends," comprise mixtures of cut or shredded pieces of flue-cured tobacco, burley tobacco and Oriental tobacco; and such blends, in many cases, also contain pieces of processed tobaccos, such as processed tobacco stems, volume expanded tobaccos and/or reconstituted tobaccos. The precise amount of each type or form of tobacco within a tobacco blend used for the manufacture of a particular smoking article can vary, and is a manner of design choice, depending upon factors such as the sensory characteristics (e.g., flavor and aroma) that are desired. See, for example, the types of tobacco blends described in Tobacco Encyclopedia, Voges (Ed.) p. 44-45 (1984), Browne, The Design of Cigarettes, 3.sup.rd Ed., p. 43 (1990) and Tobacco Production, Chemistry and Technology, Davis et al. (Eds.) p. 346 (1999). See, also, the representative types of tobacco blends set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; US Pat. App. Pub. No. 2004/0255965 to Perfetti et al.; US Pat. App. Pub. No. 2005/0066986 to Nestor et al.; PCT Pub. No. WO 02/37990 to Bereman; and Bombick et al., Fund. Appl. Toxicol., 39, p. 11-17 (1997); the disclosures of which are incorporated herein by reference in their entireties.

The tobacco can be treated with tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Additives also can be added to the tobacco using the types of equipment described in U.S. Pat. No. 4,995,405 to Lettau, which is incorporated herein by reference in its entirety, or that are available as Menthol Application System MAS from Kohl Maschinenbau GmbH. The selection of particular casing and top dressing components is dependent upon factors such as the sensory characteristics that are desired, and the selection and use of those components will be readily apparent to those skilled in the art of cigarette design and manufacture. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Further materials that can be added include those disclosed in U.S. Pat. No. 4,830,028 to Lawson et al. and US Pat. Pub. No. 2008/0245377 to Marshall et al., the disclosures of which are incorporated herein by reference in their entireties.

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Pat. No. 7,647,932 to Cantrell et al., US Pat. App. Pub. No. 2005/0016549 to Banerjee et al.; and US Pat. App. Pub. No. 2007/0215167 to Crooks et al.; the disclosures of which are incorporated herein by reference in their entireties. In addition, tobacco has been incorporated with cigarettes that have been marketed commercially under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Tobacco also has been incorporated within a smoking article that has been marketed commercially by Philip Morris Inc. under the brand name "Accord."

In further embodiments, the carbonaceous material of the substrate can comprise one or more materials that can be characterized as a tobacco substitute or a tobacco extender. Such materials simultaneously or alternately can function as a binder for the substrate. Specifically, a binder can be any material useful to maintain the substrate components as a cohesive mass. In particular embodiments, the binder can be organic, such as a polysaccharide or a derivative thereof. More specifically, the binder can be a gum, cellulose, or a cellulose derivative. Non-limiting examples of useful gums include natural gums, gum anima, gum arabic, *cassia* gum, dammar gum, gellan gum, guar gum, kauri gum, locust bean gum, spruce gum, welan gum, and xanthan gum. Non-limiting examples of celluloses and derivatives thereof that can be used include cellulose esters (e.g., cellulose acetate, cellulose triacetate, cellulose propionate, cellulose acetate propionate, cellulose acetate butyrate, nitrocellulose, and cellulose sulfate) and cellulose ethers (e.g., methylcellulose, ethylcellulose, ethyl methyl cellulose, hydroxyethyl cellulose, hydroxypropyl cellulose, hydroxyethyl methyl cellulose, hydroxypropyl methyl cellulose, ethyl hydroxyethyl cellulose, and carboxymethyl cellulose). Still further examples of useful binders include alginates, such as sodium alginate and ammonium alginate, agar, carrageenan, konjac, pectin, and gelatin. Useful binders according to the invention can also be formed of inorganic materials. Exemplary, inorganic materials that can be used include silicates (e.g., sodium silicate), silicas (e.g., colloidal silica), aluminas (e.g., colloidal alumina), silicone resin, and ceramic materials.

Fillers that may be used include calcium carbonate, aluminas, silicas, grains, and wood pulp. Exemplary types of tobacco substitutes or extenders that can be used in the substrate of the present invention are set forth in US Pat. App. Pub. No. 2008/0017203 to Fagg et al., which is incorporated herein by reference in its entirety.

One or more carbonaceous additives used in the substrate can comprise an aerosol precursor. For example, tobacco containing nicotine may be used. Thus, the inhalable substance can be a tobacco component. In some embodiments, it can be preferable to apply aerosol precursors to the substrate after it has been carbonized, as discussed below. The use of raw materials in the substrate containing inhalable substances prior to carbonization, however, is not necessarily excluded.

The substrate component of the resistive heating element (i.e., including the electrically conductive material and the carbonaceous material) is carbonized for use in the smoking article of the invention. As used herein, the term carbonized is understood as meaning that the carbonized substrate has a greater percentage of carbon by weight than the pre-carbonized substrate. As can be better understood in light of the methods of preparing the substrate further discussed below, the substrate material as originally prepared will have a defined weight percentage of carbon in relation to the total weight of the substrate. When the substrate is subjected to carbonization, a content of the non-carbon materials originally present in the substrate will be removed from the substrate such that the weight percent of carbon in the carbonized substrate relative to the total weight of the carbonized substrate exceeds the weight percent of carbon in the non-carbonized substrate relative to the total weight of the non-carbonized substrate. In some embodiments, the characterization of the substrate as being carbonized can mean that the substrate has been subjected to carbonization conditions as otherwise discussed herein. In specific embodiments, the characterization of the substrate as being carbonized can be quantitatively defined as already noted above. For example, the weight percent of carbon in the carbonized substrate can exceed the weight percent of carbon in the non-carbonized substrate by about 5% or greater, about 10% or greater, about 15% or greater, about 20% or greater, about 25% or greater, about 30% or greater, about 40% or greater, or about 50% or greater. Such carbon content can be evaluated using any suitable analytical means.

In some embodiments, the conductive substrate can be characterized as comprising a composite of carbon and a conductive material—e.g., a carbon-graphite composite. Because the conductive material is combined with the carbonaceous material prior to carbonization, the final composite material is a substantially homogeneous mixture of the carbon and the conductive material in a solid form that does not degrade upon contact with liquid (or is otherwise insoluble in aqueous medium) and that still exhibits a desirable electrical resistance, as otherwise discussed herein. Such combination of properties would not be expected to be achievable by combining carbon with a conductive material in a dry state—i.e., without undergoing the carbonization process.

The carbonized substrate further can be characterized in relation to a porosity of the substrate. During carbonization, non-carbon components of the substrate can be removed from the substrate effectively leaving behind the carbon backbone of the underlying material. As such, the carbonized substrate can have a porosity that is greater than the porosity of the non-carbonized substrate, and such porosity can be adjustable. In specific embodiments, the carbonized substrate can have an average porosity of about 10% or greater, about 20% or greater, about 30% or greater, about 40% or greater, about 50% or greater, or about 60% or greater. Such porosity can be quantified as an average of the combined microporosity and macroporosity of the material. Porosity can be quantified using any suitable method for measuring porosity, such as with industrial CT scanning, imbibitions methods, water evaporation methods, intrusion porosimetry, and gas expansion methods.

In addition to the carbonized substrate, the resistive heating element further can comprise an aerosol precursor or vapor precursor material, such as a polyhydric alcohol (e.g., glycerin, propylene glycol, or a mixture thereof) and/or water. Representative types of aerosol precursor materials are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. A preferred aerosol precursor material produces a visible aerosol upon the application of sufficient heat thereto (and cooling with air, if necessary), and a highly preferred aerosol precursor material produces an aerosol that can be considered to be "smoke-like." A preferred aerosol precursor material is chemically simple, relative to the chemical nature of the smoke produced by burning tobacco. If desired, aerosol precursor materials can be combined with other liquid materials, such as water. For example, aerosol precursor material formulations can incorporate mixtures of glycerin and water, or mixtures of propylene glycol and water, or mixtures of propylene glycol and glycerin, or mixtures of propylene glycol, glycerin, and water. Exemplary aerosol precursor materials also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

Further tobacco materials, such as a tobacco aroma oil, a tobacco essence, a spray dried tobacco extract, a freeze dried tobacco extract, tobacco dust, or the like may be combined with the vapor precursor or aerosol precursor material. As used herein, the term "tobacco extract" means components separated from, removed from, or derived from, tobacco using tobacco extraction processing conditions and techniques. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. For example, tobacco can be subjected to extraction conditions using water as a solvent; the resulting aqueous extract of tobacco then is separated from the water insoluble pulp; and then (i) the mixture of aqueous extract of tobacco within water can be used as such, or (ii) substantial amounts of the water can be removed from extracted tobacco components (e.g., using spray drying or freeze drying techniques) in order to provide a tobacco extract in powder form. Preferred tobacco extracts incorporate numerous components that are separated from, removed from, or derived from, tobacco; and are not obtained using tobacco extraction processes conditions that are highly selective to a single component (e.g., preferred extracts are not high nicotine content extracts, or extracts that can be characterized as relatively pure nicotine compositions). As such, exemplary preferred tobacco extracts possess less than 45 percent nicotine, often less than 35 percent nicotine, and frequently less than 25 percent nicotine, on the basis of the total extract weight with solvent removed (e.g., on a dry weight basis when the solvent is water). In addition, highly preferred tobacco extracts are highly aromatic and flavorful, and hence introduce desirable sensory characteristics to the aerosol produced by the smoking articles incorporating those extracts. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U.S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

The resistive heating element further can comprise one or more flavors, medicaments, or other inhalable materials associated therewith. For example, liquid nicotine can be used. Such further materials may be combined with the aerosol precursor or vapor precursor material. Thus, the aerosol precursor or vapor precursor material may be described as comprising an inhalable substance in addition to the aerosol. Such inhalable substance can include flavors, medicaments, and other materials as discussed herein. Particularly, an inhalable substance delivered using a smoking article according to the present invention can comprise a tobacco component or a tobacco-derived material. For example, the aerosol precursor material can be in a slurry with tobacco, a tobacco component, or a tobacco-derived material prior to being added to the carbonized substrate. Alternately, the flavor, medicament, or other inhalable material can be provided in a reservoir, and defined aliquots thereof may be contacted with the substrate associated with heating to release the flavor, medicament, or other inhalable material into an air stream to be inhaled by a user along with the aerosol precursor or vapor precursor material. In specific embodiments, the flavor, medicament, or other inhalable material can be deposited on a secondary substrate (e.g., a paper or other porous material) that is located in proximity to the resistive heating element. The proximity preferably is sufficient such that heating of the resistive heating element provides heat to the secondary substrate sufficient to volatilize and release the flavor, medicament, or other inhalable material from the secondary substrate.

A wide variety of types of flavoring agents, or materials that alter the sensory or organoleptic character or nature of the mainstream aerosol of the smoking article, can be employed. Such flavoring agents can be provided from sources other than tobacco, can be natural or artificial in nature, and can be employed as concentrates or flavor packages. Of particular interest are flavoring agents that are applied to, or incorporated within, those regions of the smoking article where aerosol is generated. Again, such agents can be added directly to the substrate of the resistive heating element or may be provided on a secondary substrate as already noted above. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, and pyruvic acid). The flavoring agents can be combined with the aerosol-generating material if desired. Exemplary plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties. The selection of such further components can vary based upon factors such as the sensory characteristics that are desired for the present article, and the present invention is intended to encompass any such further components that may be readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Any of the materials, such as flavorings, casings, and the like that can be useful in combination with a tobacco material to affect sensory properties thereof, including organoleptic properties, such as already described herein, may be combined with the aerosol precursor material. Organic acids particularly may incorporated into the aerosol precursor to affect the flavor, sensation, or organoleptic properties of medicaments, such as nicotine, that may be combined with the aerosol precursor. For example, organic acids, such as levulinic acid, lactic acid, and pyruvic acid, may be included in the aerosol precursor with nicotine in amounts up to being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, and about 0.1 to about 0.5 moles of lactic acid per one mole of nicotine, up to a concentration wherein the total amount of organic acid present is equimolar to the total amount of nicotine present in the aerosol precursor.

The aerosol precursor material may take on a variety of conformations based upon the various amounts of materials utilized therein. For example, a useful aerosol precursor material may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor.

As a non-limiting example, an aerosol precursor according to the invention can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a high nicotine content tobacco extract.

The manner by which the aerosol precursor material (or other material as described above) is contacted with the substrate material (e.g., the substrate of the resistive heating element or a secondary substrate) can vary. The liquid materials can be applied to a formed substrate, or can be incorporated into a secondary substrate during manufacture of the substrate. The aerosol precursor material can be dissolved or dispersed in an aqueous liquid, or other suitable solvent or liquid carrier, and sprayed onto that substrate material. See, for example, US Pat. App. Pub. No. 2005/0066986 to Nestor et al., the disclosure of which is incorporated herein by reference in its entirety. Generally, the aerosol precursor material (alone or in combination with a flavorant, medicament, and/or other inhalable substance) can be coated on, absorbed by, or adsorbed in the carbonized substrate. When multiple aerosol precursor materials and/or other inhalable substances are used, the multiple substances can be associated with the carbonized substrate individually or in any combinations of the substances. Thus, an aerosol precursor material and/or other inhalable substance can be considered to be associated with the carbonized substrate when the aerosol precursor and/or other inhalable substance has been directly applied to the carbonized substrate by any of the methods disclosed herein or other suitable method whereby the aerosol precursor and/or other inhalable substance is made to be in direct contact with the carbonized substrate and become integral with the carbonized substrate.

The amount of aerosol precursor material employed relative to the dry weight of substrate material can vary. The amount of liquid material applied to the substrate can be expressed in relation to the aerosol precursor or vapor precursor material alone or can be expressed in relation the total amount of liquid applied (e.g., aerosol precursor material plus any flavors, medicaments, or like materials to be delivered by the smoking article). The amount of liquid applied to the carbonized substrate can be such that the overall resistive heating element comprises about 5% to about 75%, about 10% to about 60%, or about 15% to about 50% by weight of the liquid component—i.e., the aerosol precursor or vapor precursor material alone or the aerosol precursor material plus any flavors, medicaments, or like materials to be delivered by the smoking article.

The conductive substrate of the invention also can be characterized in relation to the retention capacity of the substrate in relation to the aerosol precursor and/or other inhalable material that may be added to the substrate. Aerosol precursor retention capacity can be evaluated in relation to the mass of aerosol precursor retained by a defined mass of the carbonized conductive substrate under an applied centrifugal force. For example, when a carbonized conductive substrate of a defined mass is loaded with an aerosol precursor (e.g., glycerol) and then centrifuged at a gravitational acceleration (g) of 27,000, the conductive substrate can retain an amount of the aerosol precursor equal to about 25% or greater (preferably about 30% or greater, about 40% or greater, about 50% or greater, or about 55% or greater) of the mass of the substrate. For example, in one embodiment, a 60 mg conductive substrate according to the invention tested under the defined conditions can retain about 35 mg of glycerol (i.e., a retention capacity of about 58% by mass).

The amount of aerosol precursor material that is used within the smoking article is such that the cigarette exhibits acceptable sensory and organoleptic properties, and desirable performance characteristics. For example, it is highly preferred that sufficient aerosol precursor material, such as glycerin and/or propylene glycol, be employed in order to provide for the generation of a visible mainstream aerosol that in many regards resembles the appearance of tobacco smoke. Typically, the amount of aerosol-generating material incorporated into the smoking article is in the range of about 1.5 g or less, about 1 g or less, or about 0.5 g or less. The amount of aerosol precursor material can be dependent upon factors such as the number of puffs desired per cartridge used with the smoking article. It is desirable for the aerosol-generating composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol-generating material and substrate material, the amounts of those components used, and the types of tobacco material used, can be altered in order to control the overall chemical composition of the mainstream aerosol produced by the smoking article.

The aerosol precursor or vapor precursor material can be provided on the substrate in a variety of configurations. For example, the material (and any further flavors, etc.) can be applied to the substrate such that the concentration of the material along the length of the substrate is substantially constant (e.g., when dividing the substrate into a plurality of lengthwise segments, the total concentration of material in each individual segment can be substantially similar, such as varying by less than 10%, less than 5%, or less than 2% by mass). In other embodiments, liquid materials can be present along the substrate in a defined pattern. For example, the pattern may be a gradient wherein the concentration continually increases or decreases along the length of the substrate. In this manner, an individual puff on the article can provide an amount of materials that varies in relation to the previous or next puff. Any variety of such patterns may be envisioned in light of the present disclosure, and such variations are likewise encompassed by the present invention.

The amount of aerosol released by the inventive article can vary. Preferably, the article is configured with a sufficient amount of the aerosol precursor material, with a sufficient amount of any further inhalable substance, and to function at a sufficient temperature for a sufficient time to release a desired content of aerosolized materials over a course of use. The content may be provided in a single inhalation from the article or may be divided so as to be provided through a number of puffs from the article over a relatively short length of time (e.g., less than 30 minutes, less than 20 minutes, less than 15 minutes, less than 10 minutes, or less than 5 minutes). For example, the article may provide nicotine in an amount of about 0.01 mg to about 0.5 mg, about 0.05 mg to about 0.3 mg, or about 0.1 mg to about 0.2 mg per puff on the article. In other embodiments, a desired amount may be characterized in relation to the content of wet total particulate matter delivered based on puff duration and volume. For example, the article may deliver at least 0.1 mg of wet total particulate matter on each puff, for a defined number of puffs (as otherwise described herein), when smoked under standard FTC smoking conditions of 2 second, 35 ml puffs. Such testing may be carried out using any standard smoking machine. In other embodiments, the content of wet total particulate matter (WTPM) delivered under the same conditions on each puff (of approximately 2 seconds in duration) may be at least 1.5 mg, at least 1.7 mg, at least 2.0 mg, at least 2.5 mg, at least 3.0 mg, about 1.0 mg to about 5.0 mg, about 1.5 mg to about 4.0 mg, about 2.0 mg to about 4.0 mg, or about 2.0 mg to about 3.0 mg. Such values can relate to the content of aerosol precursor material that is delivered alone or in combination with any further inhalable substances that are being delivered by the article. For purposes of calculations, an average puff time of about 2 seconds can deliver a puff volume of about 5 ml to about 100 ml, about 15 ml to about 70 ml, about 20 ml to about 60 ml, or about 25 ml to about 50 ml. Such total puff volume may provide, in certain embodiments, the WTPM content previously described. Thus, WTPM as delivered may be characterized in relation to the total puff volume—e.g., about 1 mg to about 4 mg WTPM in a total puff volume of about 25 ml to about 75 ml. Such characterization is inclusive of all puff volume values and WTPM values otherwise described herein. A smoking article according to the invention can be configured to provide any number of puff calculable by the total amount of aerosol or other inhalable substance to be delivered (or the total WTPM to be delivered) divided by the amount to be delivered per puff. The conductive substrate (or plurality of individual conductive substrates) can be loaded with the appropriate amount of aerosol precursor or other inhalable substance to achieve the desired number of puffs and/or the desired total amount of material to be delivered.

The resistive heating element can be characterized in relation to the resistance of the material. Such resistance can relate to resistance in the non-carbonized form (which can be referred to as the raw substrate). Resistance further can be measured in relation to the carbonized state of the substrate (with or without an aerosol precursor material associated therewith). As further discussed herein, it was surprising according to the invention to find that the resistance of the resistive heating element can differ greatly between the raw substrate and the carbonized substrate. Thus, substrate formulations in the raw state can exhibit a resistance that makes the substrate unworkable in the inventive smoking article. On the other hand, the same substrate formulation can be transformed into a highly useful resistive heating element by the act of carbonizing the substrate. In specific embodiments, a resistive heating element formed of a carbonized substrate that can be useful according to the invention can have a resistance of about 50 ohms or less, about 30 ohms or less, about 25 ohms or less, about 20 ohms or less, about 15 ohms or less, about 10 ohms or less, or about 8 ohms or less. In particular embodiments, the resistive heating element including the carbonized substrate can have a resistance of about 0.01 ohms to about 50 ohms, about 0.05 ohms to about 25 ohms, about 0.1 ohms to about 10 ohms, about 0.2 ohms to about 8 ohms, about 0.5 ohms to about 5 ohms, or about 1 ohms to about 4 ohms. Resistance specifically can be evaluated across a basis length. For example, the foregoing resistance values can be calculated across a segment of material having a segment length of 10 mm. A different basis length, however, may be chosen for making comparative resistance measurements.

In further embodiments, heating can be characterized in relation to the amount of aerosol to be generated. Specifically, the article can be configured to provide an amount of heat necessary to generate a defined volume of aerosol (e.g., about 5 ml to about 100 ml, or any other volume deemed useful in a smoking article, such as otherwise described herein). In certain, the amount of heat generated can be measured in relation to a two second puff providing about 35 ml of aerosol at a heater temperature of about 290° C. In some embodiments, the article preferably can provide about 1 to about 50 Joules of heat per second (J/s), about 2 J/s to about 40 J/s, about 3 J/s to about 35 J/s, or about 5 J/s to about 30 J/s.

In light of the foregoing, it can be seen that certain combinations of materials and conditions can provide resistive heating elements that are particularly useful in the inventive smoking articles. For example, particular resistive heating elements can comprise the following combinations of materials, the substrates being carbonized, and the resistive heating elements having a resistance as otherwise disclosed herein:

- a substrate comprising an electrically conductive material selected from the group consisting of graphite, metals, and combinations thereof; and at least one polysaccharide; and having a polyhydric alcohol aerosol precursor material associated therewith;
- a substrate comprising an electrically conductive material selected from the group consisting of graphite, metals, and combinations thereof; and carbon particles; and having a polyhydric alcohol aerosol precursor material associated therewith;
- a substrate comprising graphite; and at least one polysaccharide; and having a polyhydric alcohol aerosol precursor material associated therewith;
- a substrate comprising graphite; and carbon particles; and having a polyhydric alcohol aerosol precursor material associated therewith;
- a substrate comprising an electrically conductive material selected from the group consisting of graphite, metals, and combinations thereof; at least one polysaccharide; and
- tobacco; and having a polyhydric alcohol aerosol precursor material associated therewith;
- a substrate comprising an electrically conductive material selected from the group consisting of graphite, metals, and combinations thereof; carbon particles; and tobacco;
- and having a polyhydric alcohol aerosol precursor material associated therewith;
- a substrate comprising graphite; at least one polysaccharide; and tobacco; and having a polyhydric alcohol aerosol precursor material associated therewith;
- a substrate comprising graphite; carbon particles; and tobacco; and having a polyhydric alcohol aerosol precursor material associated therewith;
- a substrate comprising an electrically conductive material selected from the group consisting of graphite, metals, and combinations thereof; and tobacco; and having a polyhydric alcohol aerosol precursor material associated therewith; and
- a substrate comprising graphite; and tobacco; and having a polyhydric alcohol aerosol precursor material associated therewith.

Any of the foregoing exemplary embodiments further may include one or more inhalable materials (e.g., nicotine or other flavorant) combined with the aerosol precursor material (i.e., added to the carbonized substrate either separately or in combination).

The conductive substrate useful as a resistive heating element can take on a variety of shapes, configurations, and geometries. Because of the structural stability of the carbonized conductive substrate, the substrate does not solubilize when loaded with an aerosol precursor. This makes it possible according to the invention to provide the final conductive substrate (including being loaded with an aerosol precursor) in a wide variety of shapes and sizes, including thin films, that provide uniform heating and thus uniform vapor and/or aerosol production. Accordingly, the final conductive substrate can be provided in a substantially rigid form. Moreover, the conductive substrate thus provides a resistive heater and aerosol precursor in a single, monolithic form.

In certain embodiments, the conductive substrate can be elongated (i.e., having a greater length than average diameter, average thickness, or average width). Specifically, the conductive substrate can be substantially rod-shaped. In such embodiments, the conductive substrate can have a length of about 5 mm to about 40 mm, about 7.5 mm to about 35 mm, or about 10 mm to about 30 mm. The conductive substrate likewise can have a mean diameter of about 0.1 mm to about 10 mm, about 0.2 mm to about 6 mm, about 0.5 mm to about 5 mm, or about 1.5 mm to about 3 mm. Preferably, the conductive substrate has a substantially uniform diameter. In some embodiments, however, the conductive substrate can have a non-uniform cross-sectional geometry. In further embodiments, the cross-section of the conductive substrate can have any of the following shapes: round, triangle, oval, square, rectangle, star-shaped, Y-shaped T-shaped, or the like. Generally, any shape achievable in an extrusion process through a die can be applied to the conductive substrate of the invention, although shapes that maximize surface area can be preferred. Still further, the conductive substrate can include aspects useful to increase surface area. For example, the conductive substrate can include a central passageway open at one or both ends of the conductive substrate and/or open to an outer surface of the conductive substrate at one or more locations. The exterior surface of the conductive substrate also can be shaped to increase surface area, such as being grooved or having cavities or other indentations formed therein.

The substrate of the resistive heating element can be the resulting material from any useful method of preparation. For example, the substrate can be an extrudate. In other embodiments, the substrate can be in a non-extruded form (i.e., may be molded, pressed, cut, etc.). Still further, the substrate could be pelletized, granulated, or in any further particulate form having a mean particle size in the range of about 0.1 mm to about 5 mm, about 0.25 mm to about 4.5 mm, or about 0.5 mm to about 4 mm. In other embodiments, mean particle size can be about 5 mm or less, about 4 mm or less, about 3 mm or less, about 2 mm or less, or about 1 mm or less. The particulate substrate can be filled into a suitable container (e.g., a tube or other shaped container of suitable size for use in the inventive smoking article and being formed of a material that is substantially porous to allow formed aerosol to escape therefrom) or may be otherwise compacted into a unitary body, such as through combination with a suitable binder.

In still other embodiments, the substrate can be in the form of a sheet. Such sheet can be cut to size for use in the inventive smoking device. Alternately, the sheet can be rolled, such as to be substantially tube shaped. Still further, the conductive substrate can be formed of a plurality of individual conductive substrates. For example, 2 or more, 3 or more, 4 or more, 5 or more 6 or more, 7 or more, 8 or more, 9 or more, or 10 or more individual conductive substrates (such as individual rods) can be bundled or otherwise combined to form the overall conductive substrate. Similarly, a plurality of individual conductive substrates, such as in the form of individual discs of varying thickness and diameter, can be provided as the overall conductive substrate. In exemplary embodiments, such plurality of individual conductive substrates can be provided in series in the smoking apparatus. Exemplary configurations of conductive substrates according to the invention are further described below in relation to various illustrations.

Provision of a plurality of individual conductive substrates can be advantageous for providing a number of charges of aerosol precursor material and/or for improving consistency of delivered aerosol and consistency of power requirements to form the aerosol. As such, the individual conductive substrates can be individually wired to the control components and power supply such that less than all of the individual conductive substrates are powered for aerosol production at a single time. For example, a single conductive substrate can be configured to provide approximately 8-10 puffs of two second duration—i.e., the equivalent to approximately one conventional cigarette. Thus, for example, a smoking article according to the invention can provide the number of puffs equivalent to five conventional cigarettes by including five individual conductive substrates. Other iterations also are encompassed and can be designed based upon the number of individual conductive substrates present and the number of puffs provided by each individual conductive substrate.

Although it can be preferred for the electrically conductive material and the at least one carbonaceous additive to be mixed, other embodiments are not necessarily excluded. For example, the electrically conductive material can be in the form of a core that is substantially surrounded by the at least one carbonaceous additive (which may be in the form of a sheet). Alternatively, the electrically conductive material can be in the form of a sheath that substantially surrounds a core comprising the at least one carbonaceous additive. Other configurations of combinations of the components of the resistive heating element likewise are encompassed by the present disclosure.

The resistive heating element preferably is in electrical connection with the power source of the smoking article such that electrical energy can be provided to the resistive heating element to produce heat and subsequently aerosolize the aerosol precursor material and any other inhalable substance provided by the smoking article. Such electrical connection can be permanent (e.g., hard wired) or can be removable (e.g., wherein the resistive heating element is provided in a cartridge that can be attached to and detached from a control body that includes the power source).

Further to the foregoing, the present invention also provides methods of preparing a resistive heating element that can be used in a smoking article or other device wherein heating is used to volatilize a material for delivery to a consumer via inhalation. Generally, the method can comprise combining an electrically conductive material with at least one carbonaceous additive to form a substrate wherein, after the materials are combined, the carbonaceous additive is in a carbonized state. Carbonization can comprise heating the carbonaceous additive to drive off at least a portion of the non-carbon components of the additive. More specifically, carbonization can comprise heating to a temperature of about 250° C. or greater, about 300° C. or greater, about 350° C. or greater, about 400° C. or greater, or about 500° C. or greater. Heating can be carried out for a time of about 10 minutes or greater, about 30 minutes or greater, about 60 minutes or greater, about 90 minutes or greater, or about 120 minutes or greater. Such heating can take place in any heater useful for achieving the noted temperatures, such as a Barnstead Thermolyne 62700 furnace. Carbonization particularly may proceed with ramped heating wherein the temperature is raised incrementally until the maximum calcining temperature is achieved. For example, temperature ramping for calcinations can be at a rate of about 1° C./minute to about 20° C./minute, about 2° C./minute to about 15° C./minute, or about 5° C./minute to about 10° C./minute. Preferably, carbonization can be carried out in an inert atmosphere.

Carbonization of the carbonaceous additive can be carried out prior to combination with the electrically conductive material. Alternatively, carbonization can be carried out after combination with the electrically conductive material. The substrate formed of the combination of the electrically conductive material and the at least one carbonaceous material (in the carbonized state) can have an aerosol precursor material associated therewith to form the final resistive heating element.

In certain embodiments, it can be advantageous to combine the electrically conductive material with at least one carbonaceous additive prior to any carbonization. For example, all dry ingredients used in forming the substrate can be combined initially. Combining can comprise, for example, mixing of the materials for a defined time—e.g., about 5 minutes or greater, about 10 minutes or greater, about 15 minutes or greater, about 30 minutes or greater, about 1 hour or greater, or about 2 hours or greater. Mixing can be desirable for uniformity of the combination to ensure that the electrically conductive material is substantially evenly dispersed throughout the formed substrate. Mixing also can comprise adding a liquid to the combination of materials. The liquid, such as water, can be provided such that the mixture has a moisture content of about 10% or greater, about 15% or greater, about 20% or greater, or about 25% or greater. Further exemplary liquids that can be used to add moisture to the mixture and/or for forming a dough-like consistency can include polyols, such as glycerol and propylene glycol. The formed combination of materials can be referred to as an intermediate substrate. The intermediate substrate can be characterized as being a plastic mass. This can particularly mean that the mass of the intermediate substrate can be shaped in that the substrate mass can sustain deformation continuously in any direction without rupture.

As an example, the intermediate substrate can be shaped in that it can be extruded through a suitable die such that the intermediate substrate is in the form of an extrudate. Such extrudate can have an elongated form—e.g., substantially rod shaped. Extrusion can be useful to provide the intermediate substrate with a uniform shape and uniform dimensions, particularly diameter. Of course, extrusion can be useful for forming a variety of shapes, including pellets, granules, and elongated pieces with diverse cross-sectional shapes. Still further, forming of the intermediate substrate can include forming the material into a sheet of defined thickness—e.g., about 0.1 mm to about 7 mm, about 0.5 mm to about 5 mm, or about 0.1 mm to about 2.5 mm. Such forming can include molding, cutting, and other methods. Formed sheets particularly can be rolled to form substantially tube-shaped intermediate substrates. The substrate also can be co-extruded to provide inner and outer sections that can provide different properties. For example, one section of a conductive substrate may be formed of a material more or less porous, more or less conductive, or the like, in comparison to a second section of the conductive substrate.

If desired, the intermediate substrate can be formed with a passageway therethrough. For example, the extrusion die can be constructed to extrude a continuous filament with a central passageway therethrough. The passageway can be dimensioned so as to allow for air draw through the passageway when the resistive heating element is incorporated into a smoking article as described herein. The central passageway can have an average diameter that is proportional to the average diameter of the overall heating element. For example, the average diameter of the central passageway can be about 1% to about 90%, about 5% to about 75%, about 10% to about 50%, or about 15% to about 40% of the average diameter of the carbonized substrate in the resistive heating element.

Even further, the electrically conductive material and the carbonaceous additive can be processed separately (i.e., unmixed) to form the intermediate substrate. For example, the combining step can comprise providing the electrically conductive material the form of a core (e.g., as an elongated rod or the like or as a mass of particles), and the core can be substantially surrounded by the carbonaceous additive. In such embodiments, the carbonaceous additive may be provided in a substantially dough-like consistency. The electrically conductive material further can be combined with a binder such that the electrically conductive material and the carbonaceous additive can be provided separately and be co-extruded to make the desired form. Such also could be used in a method wherein combining can comprise providing the electrically conductive material in the form of a sheath that substantially surrounds a core comprising the carbonaceous additive.

The intermediate substrate can be further processed for carbonization of the carbonaceous material. Specifically, carbonization can comprise heating for a defined period of time at a temperature as discussed above. Thereafter, the combination of materials can be referred to as a carbonized substrate. Prior to carbonization, the formed, intermediate substrate can undergo one or more drying steps to reduce the inherent moisture content. For example, the substrate can be dried at room temperature for a time of about 10 minutes to about 120 minutes, about 20 minutes to about 150 minutes, or about 30 minutes to about 90 minutes. Such drying can be used to stabilize the material prior to cutting. Cut lengths of the formed substrate can be further dried at a temperature of up to about 50° C., up to about 40° C., or up to about 35° C. for a time of about 1 hour to about 48 hours, about 4 hours to about 36 hours, or about 8 hours to about 24 hours prior to carbonization.

In some embodiments, the carbonized substrate may comprise some content of volatilizable component, and no further treatment may be required. Typically, the carbonization (or calcinization) of the carbonaceous material, however, drives away substantially all volatile components of the carbonaceous material leaving mainly only the carbon skeleton of the material. Thus, in some embodiments, the method further can comprise associating an aerosol precursor material with the carbonized substrate to form the resistive heating element. Such associating step can comprise any means combining the aerosol precursor material with the carbonized substrate in a manner wherein the aerosol precursor material can be volatilized upon resistive heating of the substrate to form an aerosol. Specifically, the aerosol precursor material can be coated onto the substrate, sprayed on to the substrate, or applied to the substrate by dipping the substrate into the aerosol precursor material. The aerosol precursor material can be vacuum deposited onto the substrate at or above room temperature. Such association can be via a coating mechanism, an adsorbing mechanism, or and absorbing mechanism. If desired, excess aerosol precursor material can be removed from the substrate, such as by centrifugation.

The resistive heating element can be formed using additional processing steps, such as cutting the material into defined lengths for use in a smoking article. Such additional processing can be applied to the intermediate substrate or the carbonized substrate. Thus, in light of the foregoing disclosure, it is evident that a resistive heating element providing an integral heater and aerosol forming substrate can be provided for combination with the further components discussed above so as to form a useful smoking article.

Although a variety of materials for use in a smoking article according to the present invention have been described above—such as heaters, batteries, capacitors, switching components, aerosol formers, and the like, the invention should not be construed as being limited to only the exemplified embodiments. Rather, one of skill in the art can recognize based on the present disclosure similar components in the field that may be interchanged with any specific component of the present invention. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

Although an article according to the invention may take on a variety of embodiments, as discussed in detail below, the use of the article by a consumer will be similar in scope. In particular, the article can be provided as a single unit or as a plurality of components that are combined by the consumer for use and then are dismantled by the consumer thereafter. Generally, a smoking article according to the invention can comprise a first unit that is engagable and disengagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

More specifically, a smoking article according to the invention can have a reusable control body that is substantially cylindrical in shape having a connecting end and an opposing, closed end. The closed end of the control housing may include one or more indicators of active use of the article. The article further can comprise a cartridge with a connecting end that engage the connecting end of the control body and with an opposing, mouthend. To use the article, the consumer can connect a connecting end of the cartridge to the connecting end of the control body or otherwise combine the cartridge with the control body so that the article is operable as discussed herein. In some embodiments, the connecting ends of the control body and the cartridge can be threaded for a screw-type engagement. In other embodiments, the connecting ends can have a press-fit engagement.

During use, the consumer initiates heating of the resistive heating element that includes the aerosol precursor material and any further inhalable substances. Such heating releases at least a portion of the aerosol precursor material in the form of an aerosol (which can include any further inhalable substances included therewith), and such aerosol is provided within a space inside the cartridge that is in fluid communication with the mouthend of the cartridge. When the consumer inhales on the mouth end of the cartridge, air is drawn through the cartridge, and the combination of the drawn air and the aerosol is inhaled by the consumer as the drawn materials exit the mouth end of the cartridge into the mouth of the consumer. To initiate heating, the consumer may actuate a pushbutton, capacitive sensor, or similar component that causes the resistive heating element to receive electrical energy from the battery or other energy source (such as a capacitor). The electrical energy may be supplied for a pre-determined length of time or may be manually controlled. Preferably, flow of electrical energy does not substantially proceed in between puffs on the article (although energy flow may proceed to maintain a baseline temperature greater than ambient temperature—e.g., a temperature that facilitates rapid heating to the active heating temperature). In further embodiments, heating may be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded. Indication that the cartridge is spent (i.e., the aerosol precursor material has been substantially removed by the consumer) can be provided. In some embodiments, a single cartridge can provide more than a single smoking experience and thus may provide a sufficient content of aerosol precursor material to simulate as much as full pack of conventional cigarettes or even more. Likewise, a plurality of individual conductive substrates can be provided in a single smoking article to provide a defined number of puffs, conventional cigarette equivalents, or the like.

The foregoing description of use of the article can be applied to the various embodiments described through minor modifications, which can be apparent to the person of skill in the art in light of the further disclosure provided herein. The above description of use, however, is not intended to limit the use of the inventive article but is provided to comply with all necessary requirements of disclosure of the present invention.

Referring now to FIG. 1, a smoking article 10 according to the invention generally can comprise a shell 15 and a plurality of components provided within the shell. The article can be characterized as having a mouthend 11 (i.e., the end upon which a consumer can draw to inhale aerosol from the article), and a distal end 12. The illustrated article is provided as a single unitary device (however, line A indicates an optional demarcation whereby the device can be two separate components that are joined together, either removably or permanently, such as by gluing). As will be evident from the further disclosure herein, it can be preferable for further embodiments of the article to be formed of two or more detachable units, each housing separate components of the article. The various components shown in the embodiment of FIG. 1 can be present in other embodiments, including embodiments formed of multiple units.

The article 10 according to the invention can have an overall shape that may be defined as being substantially rod-like or substantially tubular shaped or substantially cylindrically shaped. As illustrated in FIG. 1, the article has a substantially round cross-section; however, other cross-sectional shapes (e.g., oval, square, triangle, etc.) also are encompassed by the present disclosure. Such language that is descriptive of the physical shape of the article may also be applied to the individual units of the article in embodiments comprising multiple units, such as a control body and a cartridge.

The shell 15 of the smoking article 10 can be formed of any material suitable for forming and maintaining an appropriate conformation, such as a tubular shape, and for retaining therein the suitable components of the article. The shell can be formed of a single wall, as shown in FIG. 1. In some embodiments, the shell can be formed of a material (natural or synthetic) that is heat resistant so as to retain its structural integrity—e.g., does not degrade—at least at a temperature that is the heating temperature provided by the resistive heating element, as further discussed herein. In some embodiments, a heat resistant polymer may be used. In other embodiments, the shell can be formed from paper, such as a paper that is substantially straw-shaped. As further discussed herein, the shell, such as a paper tube, may have one or more layers associated therewith that function to substantially prevent movement of vapor therethrough. In one example, an aluminum foil layer may be laminated to one surface of the shell. Ceramic materials also may be used. In further embodiments, an insulator layer 70 can be included, specifically in the area of the shell where the resistive heating element 50 is present, so as not to unnecessarily move heat away from the resistive heating element. The insulator layer, however, can be present in other areas of the article (including substantially the entire length of the article). For example, in embodiments wherein the article comprises a control body and a separate cartridge, the control body can include an insulator layer, if desired. The insulator layer 70 can be formed of a paper or other fibrous material, such as a cellulose. Further, the shell 15 can include an overwrap 115 (as illustrated in FIG. 7*c*) on at least a portion thereof, such as at the mouthend 11 of the article, and such overwrap also may be formed of multiple layers. The overwrap can be, for example, a typical wrapping paper in a cigarette. The overwrap particularly may comprise a material typically used in a filter element of a conventional cigarette, such as cellulose acetate and thus can function to provide the sensation of a conventional cigarette in the mouth of a consumer. Exemplary types of wrapping materials, wrapping material components, and treated wrapping materials that may be used in an overwrap in the present invention are described in U.S. Pat. No. 5,105,838 to White et al.; U.S. Pat. No. 5,271,419 to Arzonico et al.; U.S. Pat. No. 5,220,930 to Gentry; U.S. Pat. No. 6,908,874 to Woodhead et al.; U.S. Pat. No. 6,929,013 to Ashcraft et al.; U.S. Pat. No. 7,195,019 to Hancock et al.; U.S. Pat. No. 7,276,120 to Holmes; U.S. Pat. No. 7,275,548 to Hancock et al.; PCT WO 01/08514 to Fournier et al.; and PCT WO 03/043450 to Hajaligol et al., the disclosures of which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. The porosity of the wrapping material can vary, and frequently is between about 5 CORESTA units and about 30,000 CORESTA units, often is between about 10 CORESTA units and about 90 CORESTA units, and frequently is between about 8 CORESTA units and about 80 CORESTA units.

To maximize aerosol and flavor delivery which otherwise may be diluted by radial (i.e., outside) air infiltration through the shell 15, one or more layers of non-porous cigarette paper may be used to envelop the article (with or without the overwrap present). Examples of suitable non-porous cigarette papers are commercially available from Kimberly-Clark Corp. as KC-63-5, P878-5, P878-16-2 and 780-63-5. Preferably, the overwrap is a material that is substantially impermeable to the vapor formed during use of the inventive article. If desired, the overwrap (or the shell if the overwrap is absent) can comprise a resilient paperboard material, foil-lined paperboard, metal, polymeric materials, or the like, and this material can be circumscribed by a cigarette paper wrap. Moreover, the article 10 can include a tipping paper that circumscribes the article and optionally may be used to attach a filter material to the article.

The shell 15, when formed of a single layer, can have a thickness of about 0.2 mm to about 5.0 mm, about 0.5 mm to about 4.0 mm, about 0.5 mm to about 3.0 mm, or about 1.0 mm to about 3.0 mm. The addition of further layers, as discussed above, can add to the thickness of the shell. Further exemplary types of components and materials that may be used to provide the functions described above or be used as alternatives to the materials and components noted above can be those of the types set forth in US Pub. No. 2010/00186757 to Crooks et al.; US Pub. No. 2010/00186757 to Crooks et al.; and US Pub. No. 2011/0041861 to Sebastian et al.; the disclosures of which are incorporated herein by reference in their entireties.

As seen in the embodiment of FIG. 1, the smoking article 10 includes an electronic control component 20, a flow sensor 30, and a battery 40, and these components can be placed in a variety of orders within the article. Although not expressly shown, it is understood that the article 10 can include wiring as necessary to provide power from the battery 40 to the further components and to interconnect the components for appropriate operation of the necessary functions provided by the article. The article 10 further includes a resistive heating element 50 as described herein. The resistive heating element 50 is in electrical connection with the battery 40. For example, the resistive heating element 50 can include terminals 51 (illustrated as being positioned at the opposing ends of the heating element) to facilitate formation of a closed electrical circuit with current flow through the heating element. Further wiring (not illustrated) can be included to provide the necessary electrical connections within the article. In specific embodiments, the article 10 can be wired with an electrical circuit such that the control component 20 delivers, controls, or otherwise modulates power from the battery 40 for energizing the resistive heating element 50 according to one or more defined algorithms, such as already described above. Such electrical circuit can specifically incorporate the flow sensor 30 such that the article 10 is only active at times of use by the consumer. For example, when a consumer puffs on the article 10, the flow sensor detects the puff, and the control component is then activated to direct power through the article such that the resistive heating element 50 produces heat and thus provides aerosol for inhalation by the consumer. The control algorithm may call for power to the resistive heating element 50 to cycle and thus maintain a defined temperature. The control algorithm therefore can be programmed to automatically deactivate the article 10 and discontinue power flow through the article after a defined time lapse without a puff by a consumer. Moreover, the article can include a temperature sensor to provide feedback to the control component. Such sensor can be, for example, in direct contact with the resistive heating element 50. Alternative temperature sensing means likewise may be used, such as relying upon logic control components to evaluate resistance through the resistive heating element and correlate such resistance to the temperature of the element. In other embodiments, the flow sensor 30 may be replaced by appropriate components to provide alternative sensing means, such as capacitive sensing, as otherwise described herein. Any variety of sensors and combinations thereof can be incorporated, as already described herein. Still further, one or more control buttons 16 can be included to allow for manual actuation by a consumer to elicit a variety of functions, such as powering the article 10 on and off, turning on the heating element 50 to generate a vapor or aerosol for inhalation, or the like.

Additionally, the article can include on or more status indicators 19 positioned on the shell 15. Such indicators, as discussed above, can show the number of puffs taken or remaining from the article, can be indicative of an active or inactive status, can light up in response to a puff, or the like. Although six indicators are illustrated, more or fewer indicators can be present, and the indicators can take on different shapes and can even being simply an opening in the shell (such as for release of sound when such indicators are present).

As illustrated in the embodiment of FIG. 1, a secondary substrate 53 is shown in proximity to the heating element 50 and preferably can be in direct contact therewith such that heat produced by the resistive heating element causes vapor formation as the aerosol precursor and any further inhalable materials are released from the substrate. A variety of substrate materials can be used in forming the secondary substrate 53. As further described herein, it can be advantageous for the heating element 50 and the secondary substrate 53 to be combined into a single component, and such combination of the component is described in relation to further figures below.

As also seen in the embodiment of FIG. 1, the article 10 includes an open cavity surrounding the resistive heating element 50 (and the secondary substrate 53). Such open cavity provides a volume for release of the aerosol from the secondary substrate 53. The article also includes a mouth opening 18 in the mouthend 11 to allow for withdrawal of the aerosol from the cavity around the resistive heating element 50. Although not expressly shown in the illustration of FIG. 1, the article can include a filter material (such as cellulose acetate or polypropylene) in the mouthend thereof to increase the structural integrity thereof and/or to provide filtering capacity, if desired, and/or to provide resistance to draw. For example, an article according to the invention can exhibit a pressure drop of about 50 to about 250 mm water pressure drop at 17.5 cc/second air flow. In further embodiments, pressure drop can be about 60 mm to about 180 mm or about 70 mm to about 150 mm. Pressure drop value may be measured using a Filtrona Filter Test Station (CTS Series) available from Filtrona Instruments and Automation Ltd or a Quality Test Module (QTM) available from the Cerulean Division of Molins, PLC. To facilitate air flow through the article, an air intake 17 can be provided and can substantially comprise an aperture in the shell 15 that allows for air flow into the interior of the article. A plurality of air intakes can be provided, and the air intakes can be positioned at any location upstream from the mouthend of the article such that air from the air intake can mingle with and facilitate removal of the formed aerosol from the cavity around the resistive heating element/substrate and through the opening in the mouthend of the article. Although not illustrated, if desired, structural elements can be provided within the article so as to effectively isolate one or more components within the article from the air flowing from the air intake to the opening in the mouthend. In other words, a defined air flow path can be provided, and such defined air flow path can substantially avoid air flowing through the air flow path from coming into physical contact with one or both of the battery 40 and the control component 20. As illustrated in FIG. 1, air taken in through the air intake 17 passes the flow sensor 30 before entering the cavity surrounding the heating element/substrate such that activation of the flow sensor will facilitate heating of the heating element, as otherwise described herein.

In preferred embodiments, the article 10 may take on a size that is comparative to a cigarette or cigar shape. Thus, the article may have a diameter of about 5 mm to about 25 mm, about 5 mm to about 20 mm, about 6 mm to about 15 mm, or about 6 mm to about 10 mm. Such dimension may particularly correspond to the outer diameter of the shell 15.

The smoking article 10 in the embodiment illustrated in FIG. 1 can be characterized as a disposable article. Accordingly, it can be desirable for the substrate 53 in such embodiments to include a sufficient amount of aerosol precursor material and any further inhalable materials (which may separately be provided on a different substrate) so that a consumer can obtain more than a single use of the article. For example, the article can include sufficient aerosolizable and/or inhalable materials such that the article can provide a number of puffs substantially equivalent to the number of puffs (of about two seconds duration) available from a plurality of conventional cigarettes—e.g., 2 or more, 5 or more, 10 or more, or 20 or more conventional cigarettes. More particularly, a disposable, single unit article according to the embodiment of FIG. 1 can provide about 20 or more, about 50 or more, or about 100 or more puffs, a single puff being measured as already described herein.

In particularly preferred embodiments an article according to the invention can comprise two units that are attachable and detachable from each other. For example, FIG. 2 shows a smoking article 10 according to one embodiment that is formed of a control body 80 and a cartridge 90. In specific embodiments, the control body may be referred to as being reusable, and the cartridge may be referred to as being disposable. In some embodiments, the entire article may be characterized as being disposable in that the control body may be configured for only a limited number of uses (e.g., until a battery power component no longer provides sufficient power to the article) with a limited number of cartridges and, thereafter, the entire article 10, including the control body, may be discarded. In other embodiments, the control body may have a replaceable battery such that the control body can be reused through a number of battery exchanges and with many cartridges. Similarly, the article 10 may be rechargeable and thus may be combined with any type of recharging technology, including connection to a typical electrical outlet, connection to a car charger (i.e., cigarette lighter receptacle), and connection to a computer, such as through a USB cable.

The control body 80 and the cartridge 90 are specifically configured so as to engage one another and form an interconnected, functioning device. As illustrated in FIG. 2, the control body 80 includes a proximal attachment end 13 that includes a projection 82 having a reduced diameter in relation to the control body. The cartridge includes a distal attachment end 14 that engages the proximal engagement end of the control body 80 to provide the smoking article 10 in a functioning, usable form. In FIG. 2, the control body projection 82 includes threads that allow the cartridge 90 to screw onto the control body 80 via corresponding threads (not visible in FIG. 2) in the distal attachment end of the cartridge. Thus, the distal attachment end of the cartridge 90 can include a open cavity for receiving the control body projection 82. Although a threaded engagement is illustrated in FIG. 2, it is understood that further means of engagement are encompassed, such as a press-fit engagement, a magnetic engagement, or the like.

The functioning relationship between the control body 80 and the cartridge 90 is further seen in FIG. 3, which shows the two detached units in cross section. The control body 80 includes the control component 20, flow sensor 30, and battery 40. Although these components are illustrated in a specific alignment, it is understood that various alignments of the components are encompassed by the invention. The control body 80 further includes a plurality of indicators 19 and an air intake 17 in the control body shell 81. A variety of positions for one or more air intakes are encompassed by the invention. As shown, the air intake 17 is positioned such that air drawn through the intake sufficiently contacts the flow sensor 30 to activate the sensor (although other positions are encompassed, particular if different sensing means are provided or if manual actuation, such as with a push button, is provided). The shell 81 can be formed of materials already described herein in relation to the embodiment of FIG. 1. A receptacle 60 also is included at the proximal attachment end 13 of the control body 80 and extends into the control body projection 82 to allow for ease of electrical connection with the resistive heating element 50 when the cartridge 90 is attached to the control body. The terminal end of the projection 82 can include an air passage 83, if desired, to facilitate air flow from the air intake in the control body into the cartridge during use of the article 10.

The cartridge 90 includes a cartridge shell 91 with a mouth opening 18 at the mouthend 11 thereof to allow passage of air and entrained vapor (and further inhalable materials, if present) from the cartridge to a consumer during draw on the article 10. The cartridge 90 further includes an insulator layer 70 and a filter 75 positioned at the mouthend of the cartridge near the opening. The cartridge shell 91, insulator layer 70, and filter 75 can be formed of materials as already described herein as being useful for such purpose. The insulator layer 70 and/or the filter 75 may be absent. The cartridge 90 further includes a conductive substrate 150 that is positioned substantially centrally within the cartridge having an open air space therearound for vapor formation. The conductive substrate effectively functions as both the resistive heating element 50 and secondary substrate 53 from FIG. 1. The conductive substrate 150 includes terminals 51 (e.g., positive and negative terminals) at the opposing ends thereof for facilitating current flow through the conductive substrate and for attachment of the appropriate wiring (not illustrated) to form an electrical connection of the conductive substrate with the plug 65 positioned at the distal attachment end 14 of the cartridge. When the cartridge 90 is connected to the control body 80, the plug 65 engages the receptacle 60 to form an electrical connection such that current controllably flows from the battery 40, through the receptacle and plug, and to the conductive substrate 150. The cartridge shell 91 can continue across the distal attachment end such that this end of the cartridge is substantially closed with the plug protruding therefrom. In other embodiments, however, the distal attachment end 14 of the cartridge 90 can include one or more air openings 93 that facilitate air flow from the control body 80 (e.g., from the air passage 83) into the cartridge. Although the air opening 93 is illustrated in FIG. 3 as an aperture in the distal end of the cartridge 90, it is not so limited. For example, the distal attachment end 14 of the cartridge 90 can have a hub and spoke design, as with the retaining element illustrated in FIG. 4*a*. Thusly, the open spaces between the spokes can function as the air openings to allow air flow from the control body 80 into the cartridge 90.

As illustrated in FIG. 3, the cartridge 90 includes a dilution air aperture 117. The dilution air aperture 117 can be useful to provide drawn ambient air into the cartridge 90 to dilute the vapor or aerosol delivered from the smoking article 10 to a consumer. The dilution air aperture 117 can be present in addition to the air intake 17 in the control body 80. Alternatively, the dilution air aperture 117 can be present instead of the air intake 17 in the control body 80. In such embodiments, when an air flow sensor 30 is utilized for detecting draw on the article 10, the flow sensor may be present in the cartridge 90 instead of the control body 80, or a flow path may be established such that air entering the air dilution aperture 117 in the cartridge contacts the flow sensor in the control body sufficiently to actuate the flow sensor and cause the programmed response from the article. In embodiments where alternate means are utilized to actuate power flow to the resistance heater (e.g., via a push button 16 as shown in FIG. 1 or a capacitance sensor), the distal end 14 of the cartridge 90 and the proximal end of the control body 80 can be fully sealed and/or the air passage 83 and the air opening 93 can be absent, and air drawn through the article 10 can be taken in fully through the air dilution aperture 117 or similar component present on the cartridge.

Generally, in use, when a consumer draws on the mouthend 11 of the cartridge, the flow sensor 30 detects the change in flow and activates the control component 20 to facilitate current flow through the conductive substrate 150. Thus, it is useful for air flow to travel through the control body 80 in a manner that flow sensor 30 detects air flow almost instantaneously. When the flow sensor 30 is positioned within the control body 80, it can be useful to have an air intake 17 on the control body. If desired, a sealed flow path may be provided such that the flow sensor 30 within the control body 80 is in fluid connection with the cartridge interior (and an air intake present on the cartridge body) after the cartridge and the control body are engaged, such fluid connection being sealed with respect to the remainder of the components within the control body but opening into the cartridge 90 when attached to the control body. Further, in other embodiments, the flow sensor 30 can be located within the cartridge 90 instead of the control body 80.

To facilitate positioning of the conductive substrate, the cartridge can include one or more retaining elements. The retaining elements preferably are formed of a material that is not electrically conductive. For example, the retaining elements may be formed substantially of the same material as the cartridge shell 91 or the insulator layer 70. The retaining elements can take on a variety of configurations with the only restriction being that the retaining elements allow sufficient air flow through the cartridge 90 such that vapor and/or aerosol formed therein passes through the mouth opening 18 of the cartridge mouthend 11 to the consumer when drawing upon the article 10.

One example of a retaining element useful according to the invention is shown in FIG. 4*a*, which is illustrative of a cross-section taken along line 4 in FIG. 3. Specifically, this embodiment illustrates a hub and spoke design wherein a plurality of spokes 55*a* connects the cartridge shell 91 to a hub 56 surrounding the conductive substrate 150. In the illustration, portions of the insulator layer 70 are cut away to reveal additional portions of the spokes 55*a* attaching to the shell 91. Alternatively, the spokes 55*a* can connect to the insulator layer 70. The dimensions of the spokes and the hub can vary. If desired, an outer ring element may be included for unifying the spokes and facilitating ease of attachment of the retainer to the shell.

Similarly, FIG. 4*b* is illustrative of a cross-section taken along line 4 in FIG. 3 wherein the retainer comprises two spokes 55*b* extending directly from the conductive substrate 150 to the insulator layer 70. Although two spokes are illustrated, more or less could be provided. If desired, a hub element likewise could be used.

The conductive substrate 150 of the invention can be provided as a single, unitary body, such as illustrated in FIG. 3, which shows a substantially rod-shaped, single conductive substrate. In other embodiments, such as already described above, the conductive substrate can be provided as a plurality of individual conductive substrates. Exemplary embodiments of conductive substrate configurations are shown in FIG. 5*a* through FIG. 5*f*, showing cross-sections of a cartridge 90 with a cartridge shell 91 and an insulator layer 70. Other elements that may be present (such as heater element retainers, a filter, and the like are omitted for simplicity), but it is understood that any combination of other elements relevant to a cartridge specifically or smoking article generally as otherwise discussed herein may be included. FIG. 5*a* through FIG. 5*d* show the conductive substrate 150 as a single, unitary component in a variety of possible cross-sectional shapes (in addition to the round cross-section already illustrated). In FIG. 5*a*, a central passageway 155 is illustrated and may be present in any of the encompassed embodiments. Such central passageway can be useful to increase the surface area of the conductive substrate for vapor formation. FIG. 5*e* and FIG. 5*f* show the conductive substrate as a plurality of individual conductive substrates 150. In FIG. 5*f*, a support band 155 is illustrated. Such support band can be present at discrete locations along the length of the conductive substrate rods or may be present along the entire length thereof and can provide a point of attachment for the conductive substrate rods and/or can function as a spacer for the conductive substrate rods. A further exemplary embodiment is shown in FIG. 5*g*, which shows a partially cut away view of a cartridge 90 formed of a cartridge shell 91. In the cartridge 90 is provided a plurality of individual conductive substrates 150 shaped as discs. Two support rods 156, 157 are shown attached to each conductive substrate disc and extending the length of the cartridge. Supports of a different arrangement may be provided. Such support rods can be useful for arranging electrical wiring (not shown) connected to the discs such that power from the battery can be delivered to the individual discs or to a plurality of the discs. As above, additional cartridge components also may be present and are not shown in this illustration only as a matter of simplicity. The number, shape, spacing, and powering (e.g., sequence or number of discs powered at a single time) of the individual conductive substrates shown in FIG. 5*g* can vary. In some embodiments, the conductive substrates arranged in series can each provide one or a plurality of charges of the aerosol precursor material and any further inhalable substance, and the control components of the smoking article can provide power to a single disc (or other shaped conductive substrate) for the designed number of puffs until the disc is considered spent and then automatically provide power to the next disc in the series to provide further puffs. In this manner, the amount of aerosol precursor and other inhalable material provided can be more precisely controlled, and any incidental damage to a single conductive substrate does not render the entire cartridge unusable.

The foregoing has described various embodiments of the invention wherein a conductive substrate is provided within a smoking article. The conductive substrate may be provided within the cartridge in a manner such that the conductive substrate is not intended to be replaceable. In other words, once the aerosol precursor on the conductive substrate has been used up, the entire article can be discarded (i.e., when the article is fully disposable), or the entire cartridge can be discarded (i.e., when the control body is reusable and the used cartridge can be replaced with a new cartridge having a new conductive substrate charged with aerosol precursor). In other embodiments, however, the smoking article of the invention can be configured such that the conductive substrate itself is removable from the article and replaceable with a new conductive substrate that is charged with aerosol precursor.

In certain embodiments, the conductive substrate can be provided in connection with a removable substrate support frame. Generally, the substrate support frame can comprise any solid material with sufficient rigidity to retain the conductive substrate therein or thereon, that provides sufficient surface area for the conductive substrate to release vapor to be entrained in air passing through the article, and that provides sufficient durability to allow for packaging and handling thereof.

As an exemplary embodiment, FIG. 6 illustrates a smoking article 10 that is formed of a single, unitary shell 15 (although the article can alternatively be formed of separable control body and cartridge components). The article 10 includes distal end 12 and a mouth end 11, which includes a removable end cap 111 having a mouth opening 18 formed therein. Within the article is a control component 20, a battery 40, and a flow sensor 30. As already described herein, the control component 20 can comprise one or a plurality of separate control components that can be housed within a single area of the article 10 or may be divided among multiple locations within the article. Likewise, the control component may be included with one or more of the battery 40 and the flow sensor 30. As such, although the control component 20 is illustrated as a single, separate component of the article, it is understood that the illustration is intended generally to indicate the presence of at least one control component within the article, and a control component separate from the battery 40 or the flow sensor 30 may not be required.

At the mouth end 11, the article 10 includes a cavity 100 providing an open space for placement of the conductive substrate and formation of vapor and/or aerosol to be drawn by a consumer from the mouth opening 18. Although not illustrated in this figure, the exemplified embodiments also can include an insulator layer, if desired, and/or a filter, which may be positioned within the removable end cap 111. It is understood that such cavity also can be present in the further illustrated embodiments discussed herein.

The article 10 also includes a receptacle 60 that is positioned within the article with a receptacle support 61. Such receptacle support 61 can be formed of any suitable material (preferably an insulating material that does not conduct electrical energy to the shell of the article) and can have any suitable dimensions for retaining the receptacle within the shell in a manner that the receptacle does not become dislodged by repeated connecting and disconnecting with a plug, such as in the manner of use of the article disclosed herein.

In contrast to the exemplary embodiments discussed above in relation to the various figures, the smoking article 10 does not include a conductive substrate or other resistive heating and/or aerosol precursor materials permanently included in the article. Instead, in these embodiments, the article is configured such that a removable conductive substrate can be removably positioned within the cavity 100 of the article. Various embodiments of removable conductive substrates that can be utilized in a smoking article 10 are illustrated in FIG. 7*a* through FIG. 7*g*. As illustrated in FIG. 7*a*, a conductive substrate 150 is positioned within a substrate support frame 250. In this embodiment, the conductive substrate 150 is substantially rod shaped; however, other shapes and dimensions as already discussed herein can be used. In use, the substrate support frame 250 can be slid into the cavity 100 of the article 10 shown in FIG. 6 through the opening at the mouthend 11 of the article when the end cap 111 is removed. The substrate support frame 250 includes a handling tab 255 at one end thereof so that the item can be handled without touching the conductive substrate 150 and possibly damaging the conductive substrate. The opposing end of the support frame 250 includes a plug 65 that connects to the receptacle 60 in the article 10 illustrated in FIG. 6. Although not illustrated, electrical wiring also will be included in the article 10 of FIG. 6 to provide any necessary electrical connections of the various components of the article, and electrical wiring likewise will be included with the conductive substrate 150 and substrate support frame 250 shown in FIG. 7*a*. As such, when the plug 65 on the substrate support frame 250 connects to the receptacle 60 in the smoking article 10, the necessary electrical connection is formed so that the removable conductive substrate 150 is functional as otherwise disclosed herein for formation of vapor and/or aerosol for inhalation by a consumer upon use of the article. The substrate support frame can be formed of any suitable material including, for example, paper, card board, polymers, or the like.

Although the placement of a single conductive substrate 150 within the substrate support frame 250 is shown in FIG. 7*a*, the invention is not so limited. For example, a plurality of individual conductive substrates 150 can be provided within the substrate support frame 250, and the individual conductive substrates can take on any useful shape or dimensions. FIG. 7*b* illustrates an embodiment wherein multiple conductive substrates 150 are positioned within the substrate support frame. Likewise, discs (as shown in FIG. 5*g*) may be positioned within a substrate support frame to provide a replaceable conductive substrate for the inventive smoking article.

FIG. 7*c* shows an end view of the mouthend 11 of the article 10 from FIG. 6 with the end cap 111 removed and a conductive substrate 150 in a substrate support frame 250 according to FIG. 7*a* inserted therein (with the handling tab 255 being visible). In the exemplary embodiment, the interior of the shell 15 of the article 10 includes grooves 175 for receiving the substrate support frame 250 and facilitate proper placement of the conductive substrate 150 within the cavity 100 such that the plug 65 properly engages the receptacle 60 to provide the necessary electrical connection for the article. Although grooves 175 are illustrated, other embodiments of guides (e.g., rails) may be used to facilitate proper placement of the removable conductive substrate within the article 10. Also illustrated in FIG. 7*c* is an overwrap 115 included on the exterior of the shell 15.

In FIG. 7*a* through FIG. 7*c*, the conductive substrate 150 is generally suspended between the components of the substrate support frame 250. In other embodiments, however, the conductive substrate can essentially be coated or "printed" onto a substrate support frame that can provide a solid backing for the conductive substrate material coated therein. FIG. 7*d*, for example, illustrates a substrate support frame 250 that is a solid, continuous backing material on which "chips" of the conductive substrate 150 are coated thereon. Again, a plug 65 is provided on one end of the substrate support frame 250, and electrical wiring (not illustrated) can be provided and can be attached directly to the substrate support frame 250. The conductive substrate chips can take on a variety of shapes and dimensions, and the sizes and dimensions can be determined so as to provide the desired total vapor and/or aerosol release desired for each chip. The length of the chip can be similar to the length values already discussed herein in relation to the conductive substrate, and the width and thickness of the chip can be similar to the diameter values already discussed herein in relation to the conductive substrate. Although one side of the substrate support frame 250 is visible in FIG. 7*d*, it is understood that further chips of the conductive substrate 150 can also be provided on the opposing side of the substrate support frame.

FIG. 7*e* shows an end view of the mouthend 11 of the article 10 from FIG. 6 with the end cap 111 removed and a plurality of chips of a conductive substrate 150 positioned on a substrate support frame 250 according to FIG. 7*d* inserted therein. In the exemplary embodiment, the interior of the shell 15 of the article 10 includes grooves 175 for receiving the substrate support frame 250 and facilitate proper placement of the conductive substrate 150 within the cavity 100 such that the plug 65 properly engages the receptacle 60 to provide the necessary electrical connection for the article. Although grooves 175 are illustrated, other embodiments of guides again may be used to facilitate proper placement of the removable conductive substrate within the article 10.

FIG. 7*f* illustrates a further example of a removable conductive substrate within a smoking article according to the invention. As seen in FIG. 7*f*, the substrate support frame 250 having a plurality of chips of conductive substrate 150 formed thereon is partially inserted into the shell 15 of the smoking article 10, fitting into grooves 175 formed in the shell wall (although other means of facilitating placement of the support frame in the cavity of the smoking article also are encompassed). Beneficially, an increase in the available surface area on the substrate support frame increases the amount of conductive substrate that may be provided on the support frame.

FIG. 7*g* shows an end view of the mouthend 11 of the article 10 from FIG. 7*f* with the end cap 111 removed and the substrate support frame 250 with a plurality of chips of a conductive substrate 150 positioned thereon fully inserted therein. In the exemplary embodiment, the interior of the shell 15 of the article 10 again includes grooves 175 for receiving the substrate support frame 250 and facilitate proper placement of the conductive substrate 150 within the cavity 100 such that the plug 65 properly engages the receptacle 60 to provide the necessary electrical connection for the article.

The control body and cartridge can be characterized in relation to overall length. For example, the control body can have a length of about 30 mm to about 100 mm, about 40 mm to about 90 mm, or about 50 mm to about 80 mm. The cartridge can have a length of about 20 mm to about 60 mm, about 25 mm to about 55 mm, or about 30 mm to about 50 mm. The overall length of the combined cartridge and control body (or the overall length of a smoking article according to the invention formed of a single, unitary shell) can be approximately equal to or less than the length of a typical cigarette—e.g., about 60 mm to about 120 mm, about 65 mm to about 110 mm, or about 70 mm to about 100 mm.

Although the cartridge and the control body can be provided together as a complete smoking article or medicament delivery article generally, the components also may be provided separately. For example, the invention also encompasses a disposable unit for use with a reusable smoking article or a reusable medicament delivery article.

In specific embodiments, a disposable unit or cartridge according to the invention can be substantially identical to a cartridge as described above in relation to the appended figures. Thus, a disposable cartridge can comprise a substantially tubular shaped cartridge shell having a distal attachment end configured to engage a reusable smoking article or medicament delivery article and an opposing mouthend configured to allow passage of a formed vapor and any further inhalable materials to a consumer. The cartridge shell can define an interior cartridge space that includes additional cartridge components. Specifically, the interior cartridge space can include a conductive substrate as otherwise described herein that provides for formation of an aerosol or vapor (and other inhalable materials, if desired) when heated via electrical current. The inner surface of the cartridge shell can include an insulator layer thereon, and the conductive substrate can be positioned within the interior cartridge space interior to the insulator layer. The conductive substrate can include further hardware (e.g., electrical wiring, electrical terminals, electrical contacts, etc) to facilitate current flow through the conductive substrate. Such further hardware can be used to provide an exterior electrical connection—i.e., means for forming an electrical connection to a power source when the disposable cartridge is engaged to a reusable control body. For example, the disposable cartridge can include an electrical plug projecting from the distal attachment end of the cartridge that can engage a receptacle in a control body. The disposable cartridge also can include attachment means, such as threads, beads, or the like to facilitate a mechanical connection with a control body.

In addition to the disposable unit, the invention further can be characterized as providing a separate control body for use in a reusable smoking article or a reusable medicament delivery article. In specific embodiments, the control body can generally be formed of a shell having a proximal attachment end (which can include one or more apertures therein) for receiving an attachment end of a separately provided cartridge. The control body further can include a power source (i.e., an electrical power source) that can be in electrical connection with one or more additional components of the control body, include components that facilitate electrical connection with a separately provided cartridge. The control body also can include further components, including components for actuating current flow into a heating member, and components for regulating such current flow to maintain a desired temperature for a desired time and/or to cycle current flow or stop current flow when a desired temperature has been reached or the heating member has been heating for a desired length of time. Thus, the control body can include a flow sensor and further control components. The control body further can comprise one or more pushbuttons associated with one or both of the components for actuating current flow. The control unit even further may comprise indicators, such as lights indicating the heater is heating and/or indicating the number of puffs remaining for a cartridge that is used with the control unit. The control body also can include attachment means, such as threads, beads, or the like to facilitate a mechanical connection with a cartridge.

Although the various figures described herein illustrate the control body and the cartridge in a working relationship, it is understood that the control body and the cartridge can exist as individual devices. Accordingly, any discussion otherwise provided herein in relation to the components in combination also should be understood as applying to the control body and the cartridge as individual and separate components.

In another aspect, the invention can be directed to kits that provide a variety of components as described herein. For example, a kit can comprise a control body with one or more cartridges. A kit further can comprise a control body with one or more charging components. A kit further can comprise a control body with one or more batteries. A kit further may comprise a control body with one or more cartridges and one or more charging components and/or one or more batteries. In further embodiments, a kit may comprise a plurality of cartridges. A kit further may comprise a plurality of cartridges and one or more batteries and/or one or more charging components. The inventive kits further can include a case (or other packaging, carrying, or storage component) that accommodates one or more of the further kit components. The case could be a reusable hard or soft container. Further, the case could be simply a box or other packaging structure.

EXPERIMENTAL

The present invention will now be described with specific reference to various examples. The following examples are not intended to be limiting of the invention and are rather provided as exemplary embodiments.

Example 1

Preparation of Conductive Substrates

Two exemplary conductive substrates were prepared for use in a smoking article according to the invention. In each case, the substrate materials were mixed and extruded to form substrates with a length of 10 mm and a diameter of 4.5 mm (Example 1a) and 4 mm (Example 1b). The formulations and measured resistance for each exemplary substrate are provided below in Table 1. Percentages are provided on a w/w basis.

TABLE 1

| Example | Formulation (wt. %) | Resistance of Calcined Extrudate (ohms) |
|---|---|---|
| 1a | Milled Carbon (64%)<br>Guar Gum (10%)<br>Graphite (20%)<br>Sodium Carbonate (1%)<br>Tobacco (5%) | 2.5 |
| 1b | Carboxymethyl cellulose (9.5%)<br>Graohite (90.5%) | 2 |

To prepare the substrates in Example 1a and 1b, all particulate ingredients were thoroughly mixed and water was added to yield a dough-like consistency with a moisture content of 39% for example 1a and 24.9% for example 1b (on a w/w basis). The dough was extruded using a batch extruder at a pressure of 10,000 psi (68.95 MPa) to form extruded rods of the diameters noted above. The female extrusion die had a tapered surface to facilitate smooth flow of the plastic mass. The die used in Example 1a was a 5-slot die, and the die used in Example 1b was smooth. A 0.025 in. (0.635 mm) steel pin was included in the die to form an axial pin hole extending the length of the center of the formed rods. Such pin hole functioned in the manner of a central passageway as otherwise described herein.

The wet rods were placed on a well-ventilated tray for approximately one hour to reduce moisture content. The semi-dry rods were then carefully cut into the 10 mm test lengths while preserving the shape of the extrudate and the integrity of the axial hole. The substrate pieces were dried overnight at room temperature and calcined in nitrogen at 800° C. for one hour in a Barnstead Thermolyne 62700 furnace to form the carbonized substrate. During calcination, the guar gum and tobacco in Example 1a and the CMC in Example 1b were converted to their respective carbon skeletons, thus increasing the porosity of the extrudates. Ramped heating was used with a ramp rate of 5° C./minute until the maximum temperature was achieved.

The calcined (i.e., carbonized) substrate pieces were impregnated with glycerol in a Precision Vacuum Oven at a temperature of 100° C. and under a 30 inch mercury (0.1 MPa) vacuum. The electrical resistance of the carbonized substrates was measured along the length of the substrates using a Fluke 179 True RMS Multimeter. The average resistance values for the samples of the conductive substrate prepared according to Example 1a and Example 1b are provided above in Table 1.

Example 2

Effect of Conductive Material Concentration on Electrical Resistance of Conductive Substrate To test the effect of the electrically conductive material in the substrate on electrical resistance, multiple conductive substrates were formed (without carbonization) and tested. In general, the conductive substrates were made by extrusion of a mixture of tobacco (a 5:3:2 ratio of flue cured, Burley, and Turkish tobaccos), graphite (from Superior Graphite Company), binder (i.e., carboxymethyl cellulose), and other additives. The exact formulations are provided in Table 2A.

In each example, the dry ingredients were mixed in a Sigma Blade Mixer (from Teledyne) for approximately one hour at low speed. Liquid ingredients were added to the mix and mixing was continued for an additional 4 hours. Sufficient water was added to ensure that the plastic mix was stiff enough to hold its shape after extrusion. The moisture content of the dough at this stage was about 31-32% (w/w). For extrusion, the plastic mix was loaded into the barrel of a batch extruder and formed into extruded rods of about 4 mm diameter per the method of Example 1. The wet rods were placed on a well-ventilated tray for approximately one hour. The semi-dry rods were then carefully cut into 10 mm lengths while preserving the shape of the extrudate and the integrity of the axial hole. The cut substrate rods were dried overnight at room temperature.

Electrical resistance was measured along the length of the rods with a Fluke 179 True RMS Multimeter, and the results are shown in Table 2A. As seen in Table 2A, graphite concentration affected electrical resistance such that an increase in graphite content resulted in decrease in electrical resistance from 210,000 ohms to 50 ohms.

In Examples 2a-2d, graphite was the only electrically conductive additive used. In examples 2e-2h, several metal powders also were tested to determine their effects on electrical resistance. Copper, aluminum and silver powders were tested as additives. In these examples, the substrates were prepared using the same method described above. As shown in Table 2B none of the metals tested showed any significant reduction in electrical resistance.

TABLE 2A

| Example | Tobacco (g) | Graphite, g (wt %) | Carboxymethyl cellulose (g) | Glycerol (g) | Propylene Glycol (g) | Resistance/ 10 mm (ohms) |
|---|---|---|---|---|---|---|
| 2a | 100 | 0 (0%) | 10 | 0 | 0 | 210,000 |
| 2b | 50 | 50 (34.4%) | 10 | 20 | 15 | 279 |
| 2c | 10 | 30 (51.7%) | 4 | 8 | 6 | 80 |
| 2d | 10 | 90 (62.1%) | 10 | 20 | 15 | 50 |

TABLE 2B

| Example | Tobacco (g) | Graphite (g) | Carboxymethyl cellulose (g) | Additive (g) | Glycerol (g) | Resistance/ 10 mm (ohms) |
|---|---|---|---|---|---|---|
| 2e | 20 | 180 | 20 | None | 40 | 28 |
| 2f | 19 | 180 | 20 | Copper (1 g) | 40 | 27 |

TABLE 2B-continued

| Example | Tobacco (g) | Graphite (g) | Carboxymethyl cellulose (g) | Additive (g) | Glycerol (g) | Resistance/ 10 mm (ohms) |
|---|---|---|---|---|---|---|
| 2g | 19 | 180 | 20 | Aluminum (1 g) | 40 | 50 |
| 2h | 10 | 180 | 20 | Silver (10 g) | 40 | 140 |

Example 3

Effect of Calcination on Electrical Resistance of Conductive Substrate

To test the effect of calcinations on the resistance of the substrate, various substrates were formed using the same methods described in Example 2. The resistance of the substrates was measured before and after undergoing calcination. The formulations, calcination conditions, and resistance values are discussed below. The tobacco blend was 50% flue cured, 30% Burley, and 20% Turkish tobacco by weight unless otherwise indicated.

3a: Rods of 100 mm length and 4 mm diameter were prepared from a formulation of 19 g tobacco blend, 180 g graphite, 20 g CMC, 1 g copper powder, and 40 g glycerol. The non-carbonized rods exhibited a resistance of about 27 ohms. After calcination at 300° C. for 1 hour, the rods exhibited a resistance of about 3.5 ohms.

3b: Rods of 10 mm length and 4 mm diameter were prepared from a formulation of 180 g graphite, 20 g CMC, 10 g copper powder, and 40 g glycerol. The non-carbonized rods exhibited a resistance of about 66 ohms. After calcination at 300° C. for 1 hour, the rods exhibited a resistance of about 2.5 ohms.

3c: Rods of 10 mm length and 4 mm diameter were prepared from a formulation of 180 g graphite, 20 g CMC, 10 g silver powder, and 40 g glycerol. The non-carbonized rods exhibited a resistance of about 140 ohms. After calcination at 200° C. for 1 hour, the rods exhibited a resistance of about 10 ohms. Alternatively, after calcination at 300° C. for 1 hour, the rods exhibited a resistance of about 1.7 ohms.

3d: Rods of 12 mm length and 4.2 mm diameter were prepared from a formulation of 66 g milled carbon, 18 g graphite, 10 g guar gum, 5 g tobacco blend (i.e., a 50/50 blend of KG-1 and KG-2 milled burley tobacco), and 1 g sodium carbonate. The non-carbonized rods exhibited a resistance of about 209,000 ohms. After calcination at 500° C. for 1 hour, the rods exhibited a resistance of about 20 ohms.

3e: Rods of 12 mm length and 4.2 mm diameter were prepared from a formulation of 48.72 g milled carbon, 10 g graphite, 10 g guar gum, 30 g calcium carbonate, and 1.28 g copper oxide. The non-carbonized rods exhibited a resistance of about 130,000 ohms. After calcination at 300° C. for 1 hour, the rods exhibited a resistance of about 30 ohms. Alternatively, after calcination at 900° C. for 1 hour, the rods exhibited a resistance of about 3.9 ohms.

3f: Rods of 10 mm length and 4.3 mm diameter were prepared from a formulation of 140 g milled carbon, 40 g graphite, and 20 g guar gum. The non-carbonized rods exhibited a resistance of about 37.9 ohms. After calcination at 900° C. for 1 hour, the rods exhibited a resistance of about 1.3 ohms.

3g: Rods of 10 mm length and 4.4 mm diameter were prepared from a formulation of 140 g graphite, 40 g tobacco blend (i.e., 5 parts flue cured tobacco, 3 parts burley tobacco, and 2 parts Oriental tobacco), and 20 g CMC. The non-carbonized rods exhibited a resistance of about 11.7 ohms. After calcination at 900° C. for 1 hour, the rods exhibited a resistance of about 1.0 ohms.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A method of preparing a resistive heating element, the method comprising:

a. combining an electrically conductive material with at least one carbonaceous additive to form an intermediate substrate;

b. heating the intermediate substrate for a defined period of time at a temperature of about 200° C. or greater to form a carbonized substrate; and c. associating an aerosol precursor material with the carbonized substrate to form the resistive heating element.

2. The method of claim 1 wherein said combining step comprises mixing for a time of about 5 minutes or greater.

3. The method of claim 1 wherein said mixing step comprising adding a liquid such that the intermediate substrate has a moisture content of about 15% or greater.

4. The method of claim 1 further comprising, after said combining step, forming the intermediate substrate into a defined shape.

5. The method of claim 4, wherein said forming step comprises extruding the intermediate substrate to form an extrudate.

6. The method of claim 1, wherein said combining step comprises providing the electrically conductive material in the form of a core that is substantially surrounded by the at least one carbonaceous additive.

7. The method of claim 1, wherein said combining step comprises providing the electrically conductive material in the form of a sheath that substantially surrounds a core comprising the at least one carbonaceous additive.

8. The method of claim 1, wherein the electrically conductive material comprises graphite.

9. The method of claim 1, wherein the electrically conductive material comprises a metal.

10. The method of claim 1, wherein the electrically conductive material is in a particulate form.

11. The method of claim 1, wherein the carbonaceous additive comprises tobacco or a tobacco derivative.

12. The method of claim 1, wherein the carbonaceous additive comprises milled carbon.

13. The method of claim 1, wherein the carbonaceous additive comprises a binder.

14. The method of claim 13, wherein the binder is a polysaccharide or a derivative thereof.

15. The method of claim 13, wherein the binder is selected from the group consisting of guar gum, carboxymethyl cellulose, and combinations thereof.

16. The method of claim 1, wherein the carbonized substrate has a porosity of about 10% or greater.

17. The method of claim 1, wherein the weight percent of carbon in the carbonized substrate relative to the total weight of the carbonized substrate exceeds the weight percent of carbon in the intermediate substrate relative to the total weight of the intermediate substrate.

18. The method of claim 17, wherein the weight percent of carbon in the carbonized substrate exceeds the weight percent of carbon in the non-carbonized substrate by about 10% or greater.

19. The method of claim 1, wherein the aerosol precursor material comprises a polyhydric alcohol.

20. The method of claim 1, wherein the aerosol precursor material comprises an inhalable substance.

21. The method of claim 1, wherein the aerosol precursor material comprises a flavorant.

22. The method of claim 1, wherein said heating step is carried out in an inert atmosphere.

23. The method of claim 1, wherein said associating step comprises coating, adsorbing, or absorbing the aerosol precursor material on or in the carbonized substrate.

24. The method of claim 1, wherein the resistive heating element has an electrical resistance of about 25 ohms or less.

25. The method of claim 1, further comprising attaching the resistive heating element to a support frame.

* * * * *